US007125277B2

(12) United States Patent
Wascow et al.

(10) Patent No.: US 7,125,277 B2
(45) Date of Patent: Oct. 24, 2006

(54) PLUG RETENTION SYSTEM

(75) Inventors: Joseph Z. Wascow, Mundelein, IL (US); Robert Hollis, Chicago, IL (US); Jason Schickerling, Mt. Prospect, IL (US); William H. Schultz, Northbrook, IL (US); Peter Domeny, Northbrook, IL (US)

(73) Assignee: Credo Technology Corporation, Broadview, IL (US)

( * ) Notice: Subject to any disclaimer, the term of this patent is extended or adjusted under 35 U.S.C. 154(b) by 12 days.

(21) Appl. No.: 10/790,361

(22) Filed: Mar. 1, 2004

(65) Prior Publication Data

US 2004/0166730 A1 Aug. 26, 2004

Related U.S. Application Data

(63) Continuation-in-part of application No. 10/096,458, filed on Mar. 12, 2002, now abandoned.

(51) Int. Cl.
*H01R 13/62* (2006.01)

(52) U.S. Cl. ..... 439/373; 439/369; 439/501

(58) Field of Classification Search ..... 439/344–345, 439/369, 373, 577, 501; 242/400.1; 191/12 R
See application file for complete search history.

(56) References Cited

U.S. PATENT DOCUMENTS

| | | | | |
|---|---|---|---|---|
| 3,544,951 A | | 12/1970 | Roberts | |
| 3,593,950 A | | 7/1971 | Tetzlaff | 248/52 |
| 4,204,738 A | | 5/1980 | Tillotson | 339/75 P |
| 4,875,879 A | * | 10/1989 | Bunyea et al. | 439/501 |
| 4,957,450 A | | 9/1990 | Pioszak | 439/369 |
| 5,037,324 A | | 8/1991 | Scheffey, Sr. | 439/452 |
| 5,318,158 A | | 6/1994 | Seasholtz | 191/12 R |
| 5,330,138 A | | 7/1994 | Schlessmann | 248/52 |
| 5,535,479 A | | 7/1996 | Pink et al. | 15/410 |
| 5,560,078 A | | 10/1996 | Toensing et al. | 15/339 |
| 5,620,336 A | | 4/1997 | Worthing | 439/501 |
| 5,644,844 A | | 7/1997 | Pink | 30/276 |
| 5,655,924 A | | 8/1997 | Cross et al. | 439/373 |

(Continued)

FOREIGN PATENT DOCUMENTS

DE 101 02 061 6/2002

(Continued)

OTHER PUBLICATIONS

Website: www.toro.com/home/yardtools/blowervacs/51586.html Power Sweep (51586).

*Primary Examiner*—Michael C. Zarroli
(74) *Attorney, Agent, or Firm*—Greer, Burns & Crain, Lt

(57) ABSTRACT

A retaining system including a power cord retaining system and a cord plug retaining system for use with a power tool. The power cord retaining system is configured for accommodating an extension cord and includes a cord capture formation for retaining the extension cord disposed on the tool, and a cord channel disposed on the tool and configured for supporting a loop of the cord substantially along an arc defined by the loop. In the preferred embodiment, the cord capture formation defines an enclosed aperture for retaining the cord at two points, and the cord channel defines a semi-circular arc for supporting the cord loop substantially along its apex. The plug retaining system is configured for maintaining electrical continuity between the plug and the receptacle and includes a contact portion for engaging a plug or a cord, and an attachment device for attaching the contact portion to the tool.

19 Claims, 13 Drawing Sheets

U.S. PATENT DOCUMENTS

| | | | | |
|---|---|---|---|---|
| 5,689,852 | A | 11/1997 | Svoboda et al. | 15/405 |
| 5,711,048 | A | 1/1998 | Pink et al. | 15/347 |
| 5,713,758 | A | 2/1998 | Goodin et al. | 439/459 |
| 5,727,745 | A | 3/1998 | Vara | 242/400.1 |
| 5,957,721 | A | 9/1999 | Searle et al. | 439/501 |
| 6,056,580 | A | 5/2000 | Cross et al. | 439/369 |
| 6,059,541 | A | 5/2000 | Beckey et al. | 417/295 |
| 6,176,729 | B1 | 1/2001 | Myers | 439/369 |
| 6,196,859 | B1 | 3/2001 | Garlarza | 439/369 |
| 6,276,952 | B1 * | 8/2001 | Ferranti et al. | 439/345 |
| 6,290,525 | B1 | 9/2001 | Jacobi | 439/319 |
| 6,443,753 | B1 | 9/2002 | Bludis et al. | 439/373 |
| 6,443,762 | B1 | 9/2002 | Lessig, III | 439/528 |
| 6,491,539 | B1 | 12/2002 | Johnston | 439/373 |
| 6,712,637 | B1 * | 3/2004 | Rosa et al. | 439/373 |
| 2002/0068477 | A1 | 6/2002 | Chen-Chiang et al. | 439/373 |
| 2002/0072267 | A1 | 6/2002 | Bowling et al. | 439/358 |

FOREIGN PATENT DOCUMENTS

| | | |
|---|---|---|
| EP | 0 600 736 A1 | 6/1994 |
| EP | 0 712 598 A1 | 5/1996 |
| EP | 0 893 621 A1 | 1/1999 |
| GB | 2381391 | 4/2003 |

* cited by examiner

PLUG RETENTION SYSTEM

RELATED APPLICATION

This is a Continuation-In-Part of U.S. Ser. No. 10/096,458 filed on Mar. 12, 2002 entitled "Extension Cord Retention System," now abandoned.

BACKGROUND OF THE INVENTION

The present invention relates generally to portable electric power tools designed for use with extension cords, and specifically to a system for securely retaining the extension cord to the tool in a way which reduces stress on the cord, and which prevents cord pullout.

Conventional portable electric power tools, including but not limited to drills, hammer drills, sanders, grinders, circular saws, reciprocating saws, routers, power fastener drivers, garden weed trimmers, leaf blowers and the like are typically provided with a power cord which, depending on the manufacturer and model, varies in length from about six inches to about 12 feet. Regardless of the length of the standard equipment cord or tool cord, users often need to employ extension cords to reach remote work sites. For example, on construction sites, long extension cords are often connected to portable generators. In such cases, if the extension cord is merely plugged into the tool cord, pulling on the tool, which often occurs during use, may cause the extension cord to become detached from the tool cord, which disrupts work and is frustrating to the operator. Also, the junction of the tool cord and the extension cord often becomes caught on workplace obstructions, causing the tool to become disconnected from the extension cord.

To address this problem, operators often tie adjacent ends of the extension and tool cords together in a knot. While making a more secure junction, the knot has a tendency to become caught on workpiece edges or on other surfaces, requiring the operator to interrupt work and free the caught knot. Another disadvantage of the knot is that it requires tight bends to be made in both the tool cord and the extension cord. Repetitive sharp bending stresses of this type cause stresses on the internal wiring of the cords and may result in fraying of the cords and/or short circuits.

One attempted solution to this problem is to provide a tool which lacks a tool cord, but instead has an electric receptacle for directly receiving an extension cord. While this solution removes the problems associated with the extension cord-tool cord knot, a new problem is introduced in that pulling on the tool during work or movement causes the extension cord to become detached from the tool. The plug is vulnerable because it is only held in place by the friction between the receptacle and the plug, which can vary depending on the plug manufacturer and by the amount of wear. As the plug wears, its ability to grip the male receptacle blades decreases resulting in degradation of fit, increasing the ease by which the plug can become disconnected. Further, as the plug loosens, power to the tool may become intermittent or be completely lost. When this occurs, work is interrupted, which is often frustrating to the operator. Also, tool vibration may cause loosening of otherwise securely held extension cord plugs.

To address the problem of retention of the extension cord on the tool, tools have been provided with cord retention and plug retention systems. Such systems are typically configured with formations such as hooks and/or loops which bend the extension cord in a serpentine manner near the tool receptacle and thus isolate the cord plug from a pulling action on the cord. In this manner, pulling on the tool while attached to the cord will not cause the extension cord to become unplugged from the tool.

However, such conventional systems are often unsatisfactory because they cause excessive and/or sharp bends in the cord, which shorten the life of the extension cord and may cause short circuits. Such stresses occur when the cord is forced into sharp bends around hooks or other projections. One related and important design criteria of such systems is that construction workers working on ladders or on second stories of buildings often raise and/or lower the tool by the cord. Especially with heavier tools, this places a significant load on the cord. When the cord has sharp bends, particularly where the cord leaves the retention system, there is excessive and potentially damaging stress placed on the cord. This problem is especially severe where the retention system creates a right angle bend in the cord as it exits the system. In instances where the tool has a tool cord, the stresses are severe enough to cause the tool cord to be pulled out of the tool.

Another disadvantage of conventional cord retention systems is that the cord is not sufficiently secured in the system or at other locations on the holder. One problem resulting from this disadvantage is that when a tool is moved backward, as in a sawing motion, a slack condition in the extension cord may cause the cord to become disengaged from portions of conventional systems. Another problem is that when operating in heavy vegetation or crowded work environments, the many cord loops created by conventional systems are prone to becoming caught on branches or other environmental obstructions, which may cause the cord to become detached from the retention system.

Still another disadvantage of conventional extension cord retention systems relates to the fact that extension cords are provided in a variety of gauges or thicknesses. Conventional cord retention systems are incapable of accommodating a wide range of cord gauges.

Accordingly, there is a need for an improved cord retention system for a power tool which reduces stress on the cord, especially when the cord is used to raise and/or lower the tool.

Another need is for an improved cord retention system for a power tool which positively secures the cord to the tool.

Still another need is for an improved cord retention system for a power tool which accommodates a range of extension cord gauges.

A further need is for an improved plug retention system for a power tool which positively secures the plug to the tool.

Yet another need is to provide an improved plug retention system which accommodates a variety of types of extension cords.

A still further need is to provide an improved cord retention and plug retention system which positively secures the cord and the plug to the tool.

BRIEF SUMMARY OF THE INVENTION

The above-listed needs are met or exceeded by the present power tool extension cord retention system, which features an arrangement where the retained extension cord is subjected to only gradual loops so that sharp turns and kinks are avoided. Furthermore, the formed cord loop is supported in a way that minimizes stress on the cord when the cord is pulled, as when the tool is urged forward during work, or the cord is used to raise or lower the tool from an elevated work place. In addition, a cord lock is provided to the present system to secure the cord in place during both loaded and slack cord conditions.

An extension cord plug retaining system is also provided which engages the extension cord plug to maintain electrical continuity between the plug and the tool.

More specifically, the present extension cord retaining system provides a power cord retaining system for use with a power tool configured for accommodating an extension cord. The system includes a cord capture formation for retaining the extension cord disposed on the tool, and a cord channel disposed on an outside surface of the tool and configured for supporting a loop of the cord substantially along an arc defined by the loop.

In the preferred embodiment, the cord capture formation defines an enclosed aperture for retaining the cord at two points, defining a cord loop therebetween, and the cord channel defines a semi-circular arc for supporting the cord loop substantially along its apex. A cord lock is preferably formed in association with the cord channel for releasably locking the cord in the channel and preventing unwanted cord release.

In another embodiment, a power cord retaining system is provided for use with a power tool configured for accommodating an extension cord, and includes a cord channel disposed on the tool and defining a radius configured for supporting a loop of the cord substantially along an arc defined by the loop. In yet another embodiment, a power cord retaining system is provided for use with a power tool configured for accommodating an extension cord. The system includes a cord capture formation for retaining the extension cord disposed on the tool and a cord channel disposed on the tool and configured for supporting a loop of the cord substantially along an arc defined by the loop. The capture formation and the channel are disposed on the tool so that the cord engages the system along an axis which is parallel to a longitudinal axis of the tool.

A plug retaining system includes a contact portion configured for engaging the plug disposed on the tool and an attachment device configured for attaching the contact to the tool. The attachment device is preferably a ring disposed on the tool configured for attaching the plug retaining system to the tool. The ring preferably has an attachment formation which is configured for engaging corresponding structure on the tool. At least one finger extends from the ring and is configured to contact and engage the plug. Several alternate plug retention embodiments are disclosed.

Further, a retaining system is also disclosed including a power cord retaining system and a cord retaining system for accommodating an extension cord on a power tool, and configured for maintaining electrical continuity between the plug and the tool.

DETAILED DESCRIPTION OF THE INVENTION

Figure 1:
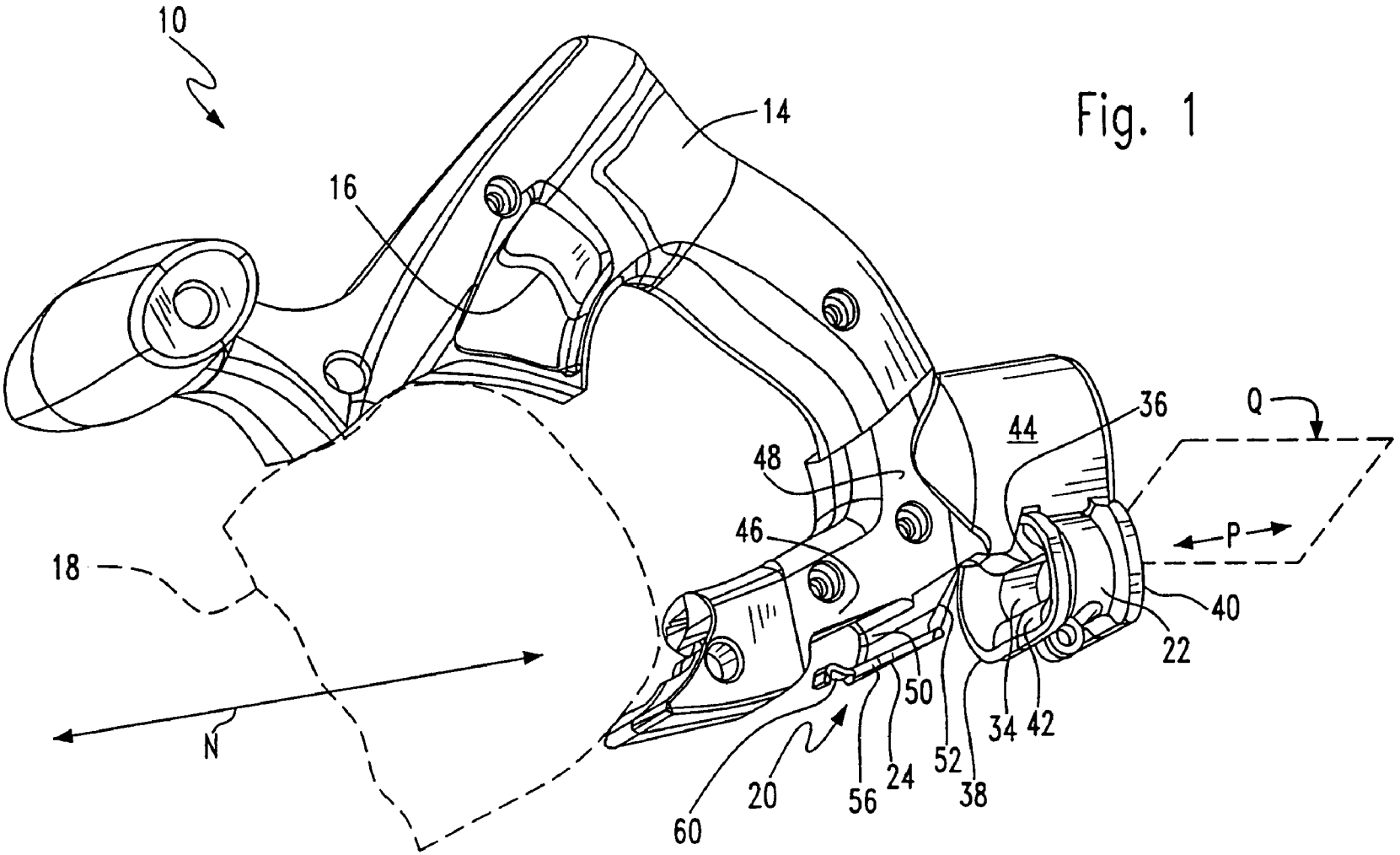
FIG. 1 is a front perspective view of a tool handle incorporating the present cord retaining system.
Figure 2:
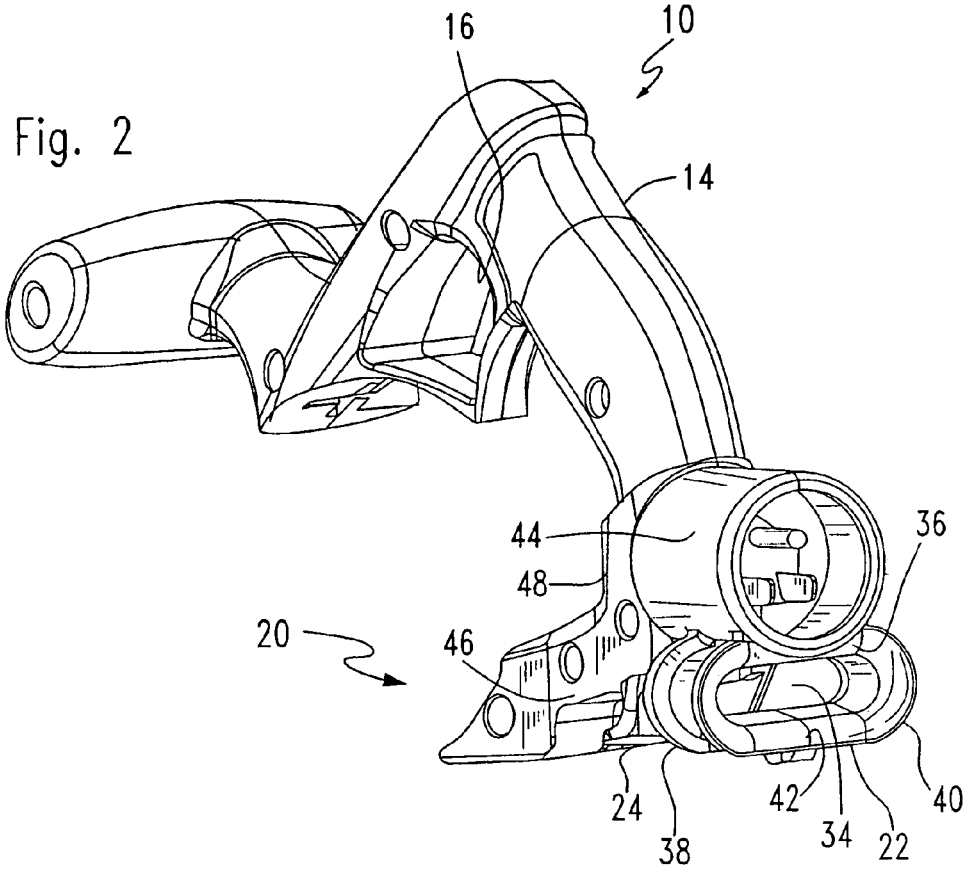
FIG. 2 is a rear perspective view of the tool handle of FIG. 1.
Figure 3:
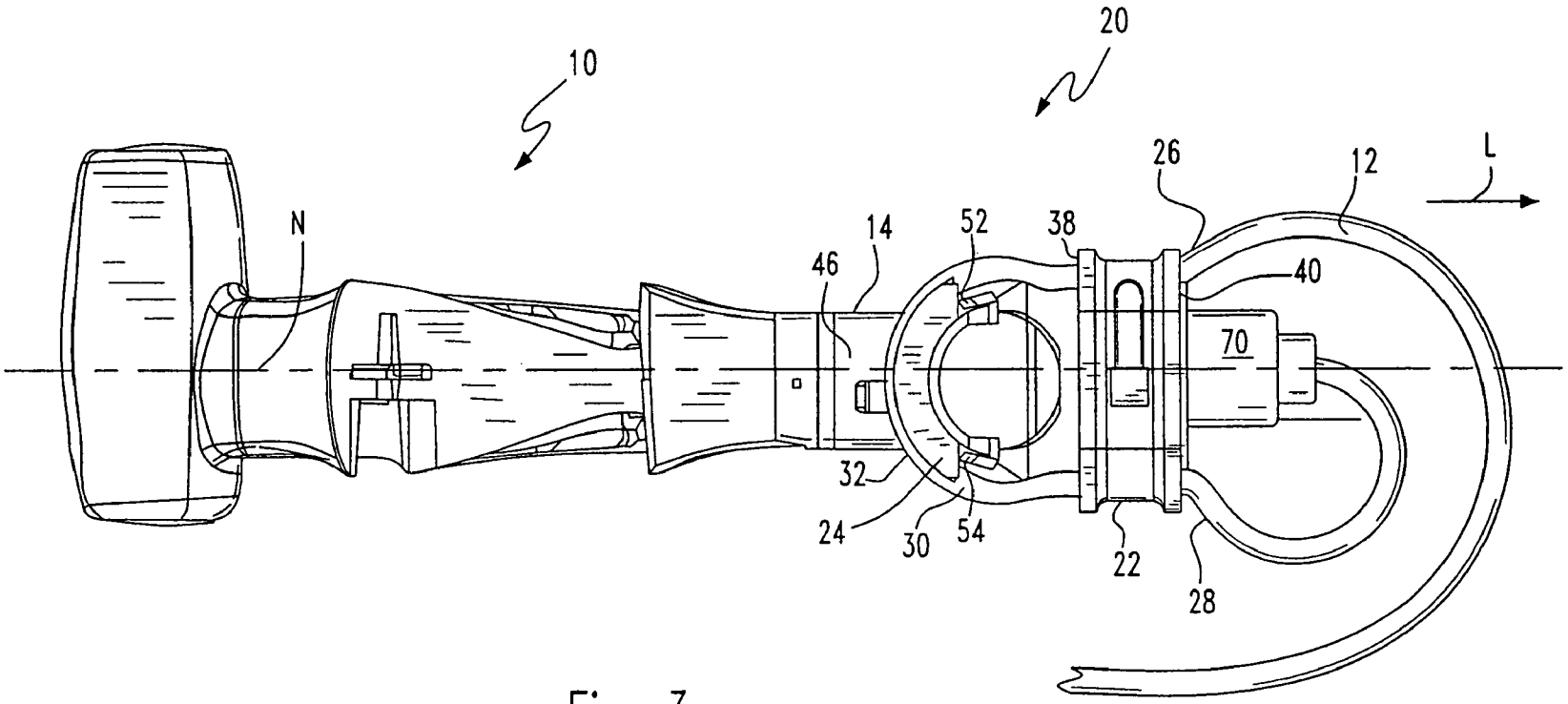
FIG. 3 is a bottom view of the tool handle of FIG. 1 shown with an extension cord in place.

Referring now to FIGS. 1–3, a power tool generally designated 10 is shown fragmentarily, and is contemplated as being any one of a group of commonly known portable electric power tools, including, but not limited to drills, hammer drills, sanders, grinders, circular saws, reciprocating saws, routers, power fastener drivers, garden weed trimmers, leaf blowers and the like, all being commercial or homeowner-type power tools commonly used with an extension cord, generally designated 12 (best seen in FIG. 3). The extension cord 12 is of the type commonly used in conjunction with wall sockets or portable generators used on job sites. The length of the cord 12 may vary as well as its gauge or diameter and still be suitable for use with the present invention. However, for commercial applications, the extension cord 12 will typically be made of 10, 12 or 14 gauge cable.

The power tool 10 has a handle portion 14 and an actuator trigger 16. In the preferred embodiment, the handle portion 14 is made of molded rigid plastic, however, other suitable materials are contemplated such as cast aluminum, stainless steel, etc. as are well known in the tool art. If provided, the configuration of the handle portion 14 and the trigger 16 may vary to suit the application. Opposite the tool handle portion 14 is a working end 18 (shown in phantom in FIG. 1) which includes components (not shown) as are known in the art for performing the designated work desired for a particular tool.

In the preferred embodiment, the cord retaining system, generally designated 20, is secured to the handle portion 14, as by being integrally molded thereto. However, other types of attachment are contemplated, including chemical adhesives and threaded fasteners. Two main components make up the cord retaining system 20, a cord capture formation 22 and a chord channel 24. The cord capture formation 22 is configured for retaining the extension cord 12 at at least two points of contact 26, 28 (FIG. 3), with a loop portion 30 of the cord formed between the two points. The cord channel 24 receives and supports an apex 32 of the loop portion 30.

More specifically, the cord capture formation 22 is configured to define an enclosed space 34 when attached to the tool 10. Thus, the capture formation 22 may define a circular, oval, free form or other preferably non-cornered shape on its own or using a portion 36 of the tool 10 (depicted as part of the handle portion 14). A non-cornered shape is preferred to avoid sharp edges which may cause wear or stress on the extension cord 12. Further, the cord capture formation 22 is configured for maintaining an orientation of the cord 12 that prevents bends and kinks in the cord when the cord is retained in the system 20.

The capture formation 22 includes first and second ends also termed front and rear ends 38, 40. An important feature of the present cord capture formation 22 is that at least one and preferably both of the ends 38, 40 are configured with a fully radiused or rounded edge 42 to prevent unnecessary wear or stress on the extension cord 12. Further, as will be seen in FIG. 2, the ends 38, 40 are outwardly flared to further promote ease of insertion and retention of the cord 12.

Another aspect of the cord capture formation 22 is that it is preferably located in close proximity to an electrical receptacle 44 which is preferably integrally joined to the handle portion 14, however other configurations are contemplated depending on the application. It will be seen that the tool 10 defines a longitudinal axis, and the cord capture formation 22 is preferably oriented on the tool 10 so that the enclosed space 34 is coaxial or parallel to the longitudinal axis of the tool. While the cord capture formation 22 is shown preferably positioned on a lower end 46 of the tool 10, it is contemplated that other positions may be suitable, including on one side 48 of the tool, depending on the application.

Referring now to the cord channel 24, the other portion of the present retention system 20, an important feature of the present system is that the cord channel 24 supports the apex 32 of the loop portion 30 along a substantial portion of its length. To that end, and so that kinks and sharp bends in the extension cord 12 are prevented, the cord channel 24 is preferably formed into a semi-circle or arcuate shape which depends from the lower end 46 of the tool 10. The preferably semi-circular or arcuate shape of the cord channel 24 minimizes the wear and stress on the extension cord 12 while positively retaining the cord on the tool 12.

In addition, the cord channel 24 defines an arcuate or "C"-shaped groove 50 (best seen in FIG. 4) which is curved along its vertical dimension to accept the profile of the extension cord 12. It is preferred that leading and trailing edges 52, 54 of the cord channel 24 are inclined to facilitate cord placement. Also, to prevent excessive cord wear, an outer lip 56 of the channel 24 is also radiused. Further, the channel 24 is preferably configured to avoid abrupt, transverse changes in direction along the length of the channel which may also cause wear or stress on the extension cord 12. Instead, the cord channel 24 is configured so that the cord 12 is supported along an arcuate, corner-free loop defining an approximate 180-degree change in direction of the cord.

The cord channel 24 is preferably disposed on an outside surface 58 of the tool 10 and is configured for facilitating placement of the extension cord 12 in the cord capture formation 22 during installation and removal of the cord. Since the cord capture formation 22 is disposed on the outside surface 33 of the tool 12, the engagement of the extension cord 12 on the formation is visible. This configuration allows the user to visually verify whether the extension cord 12 is securely disposed in the cord capture formation 22, and enables the user to make corrections to the alignment of the cord in the capture formation, or any other correction. The cord capture formation 22 is also preferably disposed on the outside surface 58 of the tool 10, and is further preferably constructed and arranged for the user to view the cord 12 and the cord channel 24 when the cord is installed and removed on the cord channel.

Figure 5:
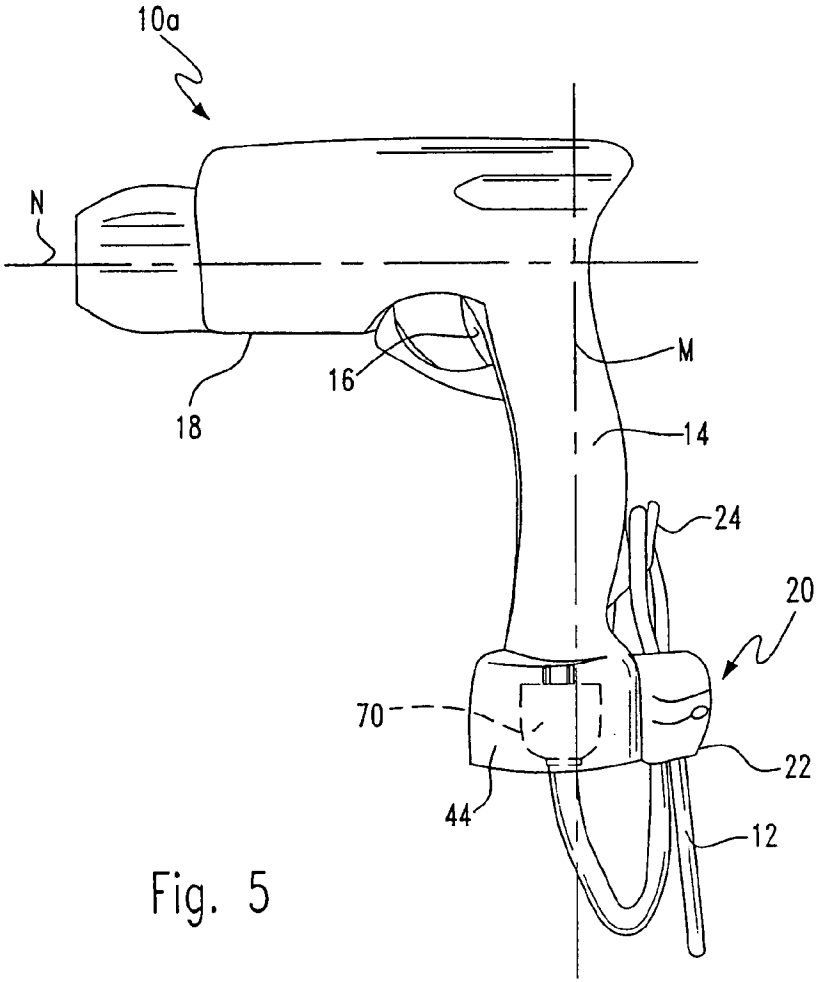
FIG. 5 is a side view of a tool featuring an alternate arrangement of the cord retaining system of FIG. 1.

Referring now to FIGS. 3 and 5, for best results, the cord capture formation 22 and the cord channel 24 are linearly aligned on the tool 10 along a major tool axis. In the embodiment of FIG. 3, the capture formation 22 and the cord channel 24 are aligned along the longitudinal tool axis "N". However, in FIG. 5, the capture formation 22 and the cord channel 24 are disposed along an axis "M" defined by the handle portion 14 of a generally "L"-shaped tool 10*a*. The other major axis is designated "N" for the tool 10*a*. Thus, some tools may have a single major axis, that being the longitudinal axis, but other tools may have two major axes, as in the case of "L"-shaped tools 10*a*.

Also, given that the tool 10, 10*a* generally defines a vertical plane, the system 20 is constructed and arranged so that the cord capture formation 22 and the cord channel 24 are in operational relationship to each other on the tool 10, 10*a* to restrain the cord loop of cord in a cord plane "P" which is generally parallel to the corresponding major axis of the tool. Also, the formation 22 and the channel 24 are spaced apart a sufficient distance for allowing the cord 12 to easily clear the formation 22 and engage the channel 24 without kinking or bending, other than forming the loop portion 30. It will be seen from FIGS. 3 and 5 that it is also preferred that the cord channel 24 is closer to the working portion 18 of the tool 10 than the cord capture portion 22.

Figure 6:
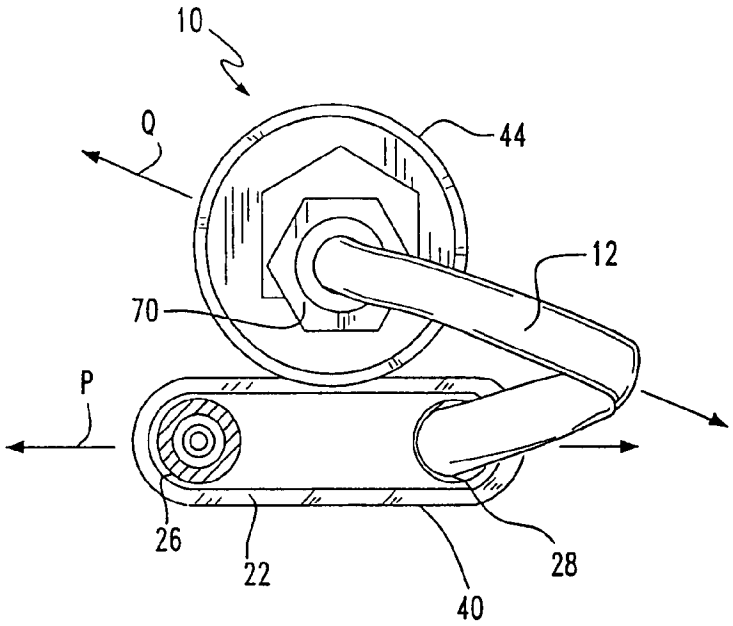
FIG. 6 is a fragmentary rear view of the tool of FIG. 1 showing the cord loop planes defined by the cord retaining system of FIG. 1.

Once the cord 12 is secured in the receptacle 44 and in the system 20, it will be seen that the retained cord forms only two loop planes, the plane P and a second plane Q which is generally inclined relative to the plane P (best seen in FIG. 6). The degree of inclination of the plane Q to the plane P may vary to suit the application. By minimizing the number of cord loop planes, kinking and sharp bending of the cord 12 is prevented.

Referring now to FIG. 1, another feature of the present system 20 is that once in the cord channel 24, the extension cord 12 is releasably locked in place by a cord lock 60. As illustrated, the cord lock 60 is preferably a biased locking tab which is integrally formed with the cord channel 24. However, it is contemplated that the cord lock 60 could take other forms, including clips, hinges, latches, wedges, any of which retain the cord in place in the channel 24. In the preferred embodiment, the cord 12 is retained in the groove 50 by a snap fit provided by the lock 60.

Figure 4:
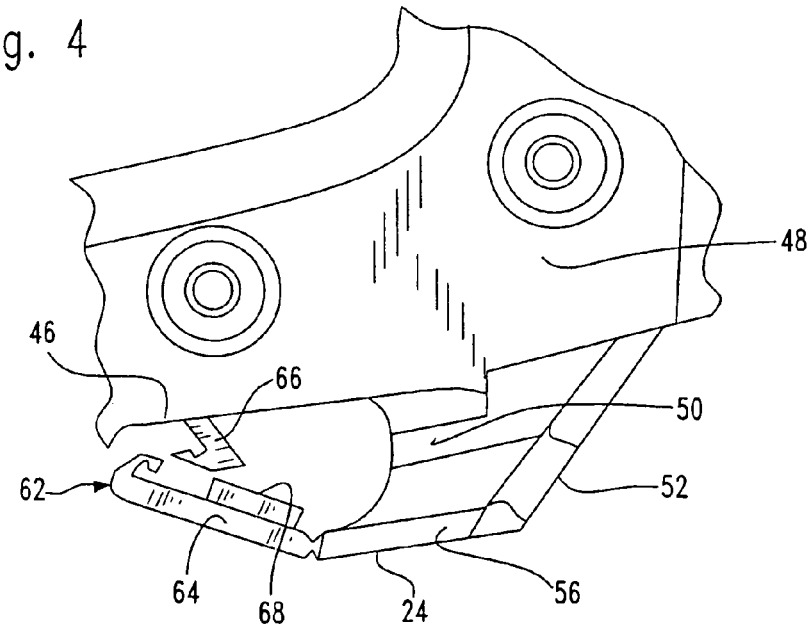
FIG. 4 is a fragmentary side view of the system of FIG. 1 showing a cord lock feature.

Referring now to FIG. 4, since it is contemplated that the system 20 may be used with extension cords 12 having a variety of gauges, if the dimensions of the cord channel 24 and, particularly, the cord lock 60 are fixed, there is a possibility that if the cord lock is configured for a larger diameter cord, then if a smaller diameter cord is used, it may not be properly retained. To that end, a cord lock latch 62 is provided, in which a latch member 64 engages a catch 66 in the lower end 46 of the tool 10. As is known in the art, the latch member 64 is preferably pivotable relative to the cord channel 24, such as by being integrally molded to form a "living hinge", or joined to the channel with a pivot pin (not shown). To further accommodate a variety of cord gauges, the latch member 64 may be provided with a resilient pad 68 for taking up extra space between the latch member and the cord 12 if needed.

To secure the cord 12 in the tool 10, the user forms the loop 30 in the cord near a plug 70 and inserts the loop through the cord capture formation 22. The loop 30 is then placed around the cord channel 24 and is pressed into the groove 50. The cord lock 60 or 62 secures the cord 12 in place in the groove 50. Next, the plug 70 is engaged in the receptacle 44 as is well known in the art. As seen in FIGS. 3 and 5, if a load "L" is placed on the cord 12 while secured to the tool 10 by the present system 20, such as when the tool is lowered or raised by the cord 12 from an elevated location, it will be seen that the cord is not subject to stresses caused by sharp bends or kinks.

Figure 7:
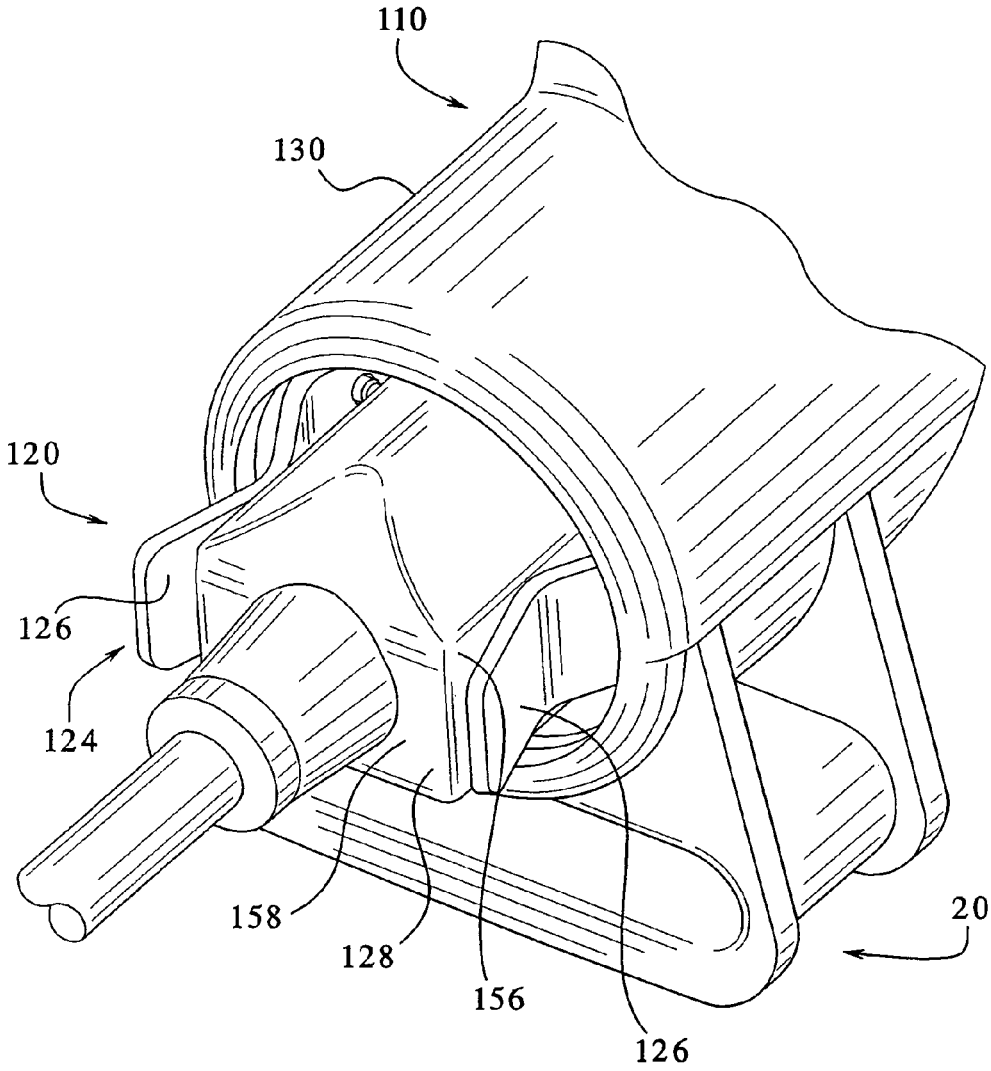
FIG. 7 is perspective view of a docking recess of a tool incorporating a first embodiment of the present plug retaining system and shown with an extension cord plug in place.
Figure 8:
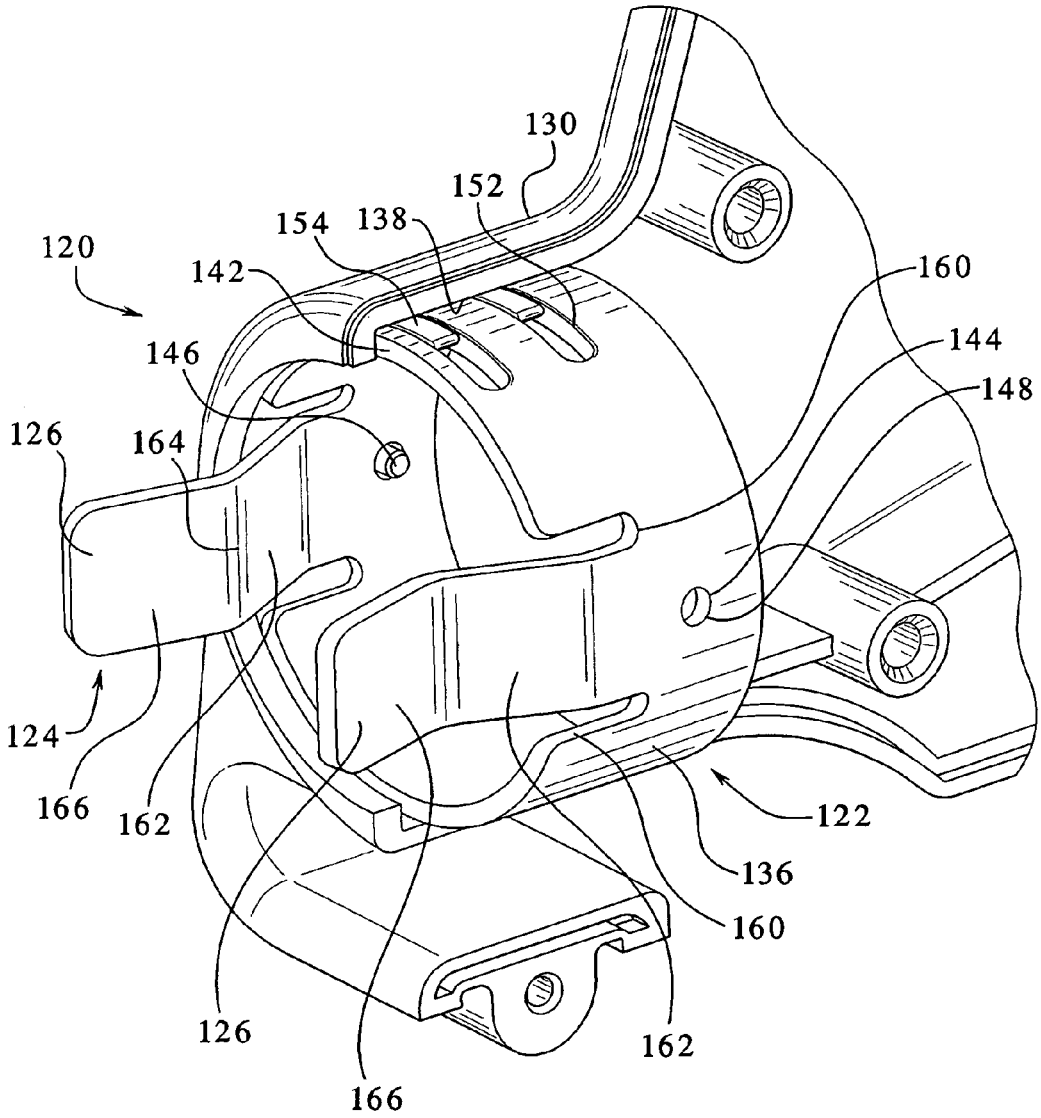
FIG. 8 is a partial cut-away perspective view of the tool of FIG. 7.
Figure 9:
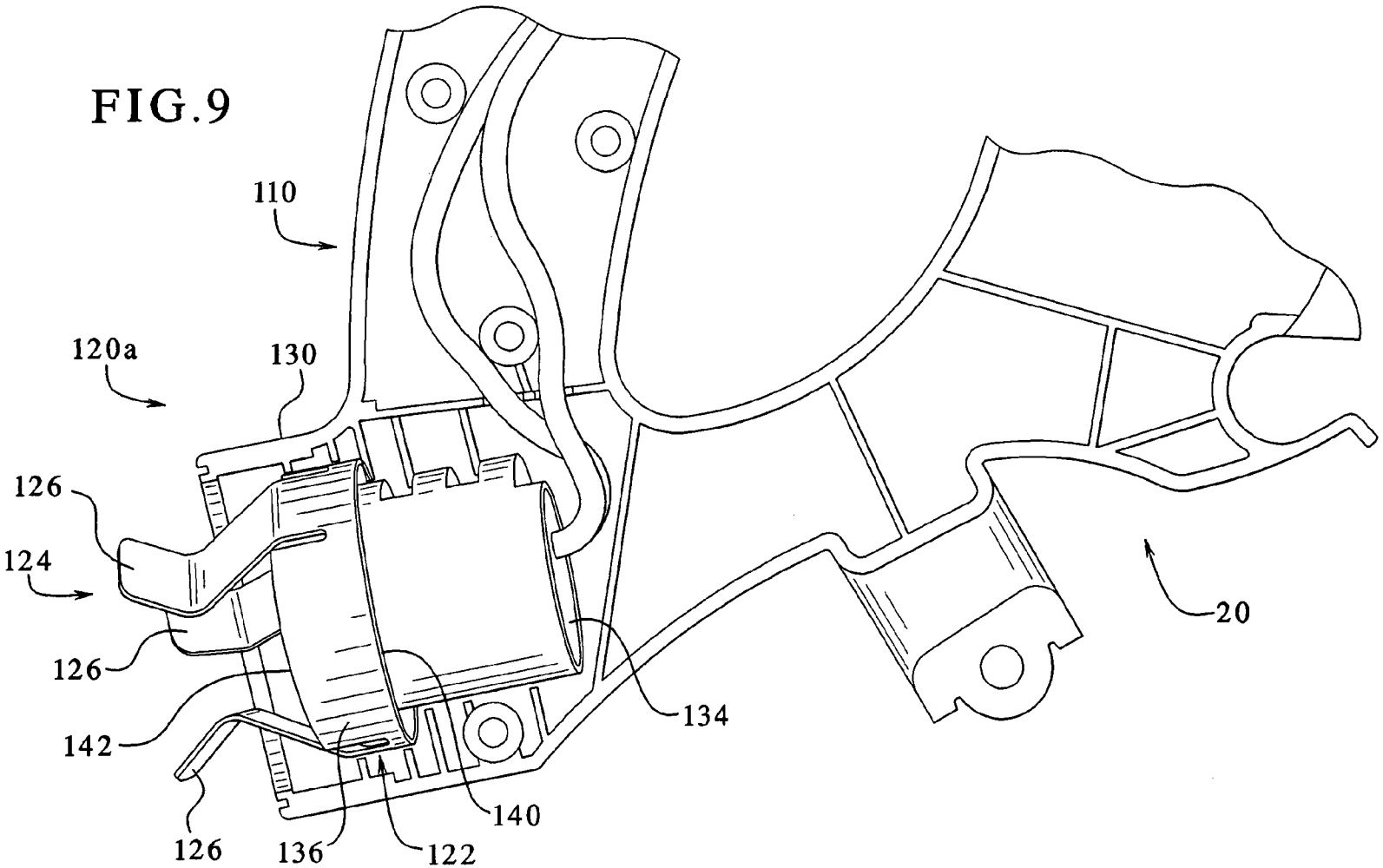
FIG. 9 is a partial cut-away side elevation of the tool of FIG. 7.

Referring now to FIGS. 7–9, working in conjunction with the cord retention system 20 is a plug retaining system generally designated 120 having an attachment device 122 and a contact portion 124. Shared components with the cord retention system 20 are designated with identical reference numbers. The attachment device 122 attaches the plug retaining system 120 to the tool 110 at at least one location, while the contact portion 124 is configured for releasably securing or retaining a plug 128 in operational position on the tool 110. At least one finger 126 contacts the plug 128 and exerts a radial clamping force on the plug. Together, the attachment device 122 and the contact portion 124 are configured for maintaining electrical continuity between the plug 128 and the tool 110. Specifically, the plug retaining system 120 is configured for retaining the plug 128 in a receptacle 134 (FIG. 9) of the tool 110 so that electrical contact is maintained between the plug and the receptacle.

A docking enclosure 130 is disposed on the tool 110 and is the portion of the tool which encapsulates a plug interface 132 (FIGS. 13 and 14) of the receptacle 134 (FIG. 9) and receives the plug 128. Protruding outwardly beyond the plug interface 132 (FIGS. 13 and 14), the docking enclosure 130 is generally cylindrical and is configured to encapsulate a portion of the plug 128 when it is engaged with the receptacle 134 and to protect the connection at the interface 132. Other docking enclosure 130 configurations are contemplated.

The attachment device 122 includes a generally thin ring 136, preferably made of metal, having an outside diameter slightly smaller than the inside diameter of the docking enclosure 130. Preferably, the ring 136 is configured to be inserted into the docketing enclosure 130 to engage an inner surface 138 of the docking enclosure, and to be generally co-axial with both the docking enclosure and the plug receptacle 134. Further, the ring 136 has an interior end 140 and an exterior end 142, the interior end is configured so that, when disposed in the docking enclosure, it is proximate to an interior of the tool 110.

Figure 13:
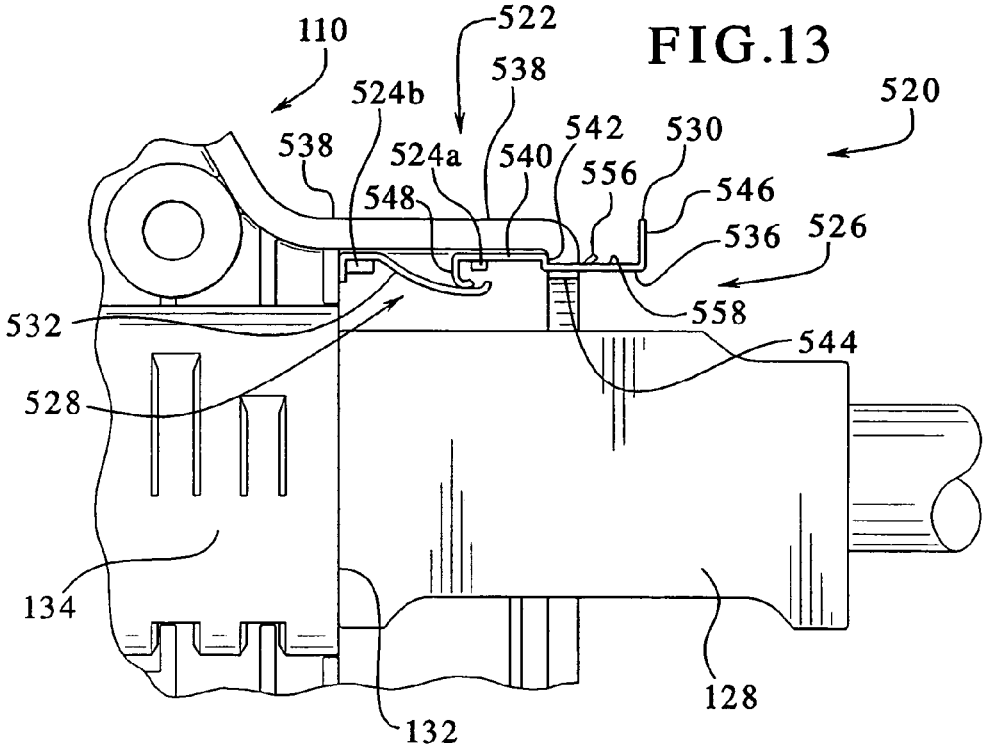
FIG. 13 is a partial cross-section view of a docking recess of a tool incorporating a fifth embodiment of the present plug retaining system and shown with an extension cord plug in place and the system in an outward position.
Figure 14:
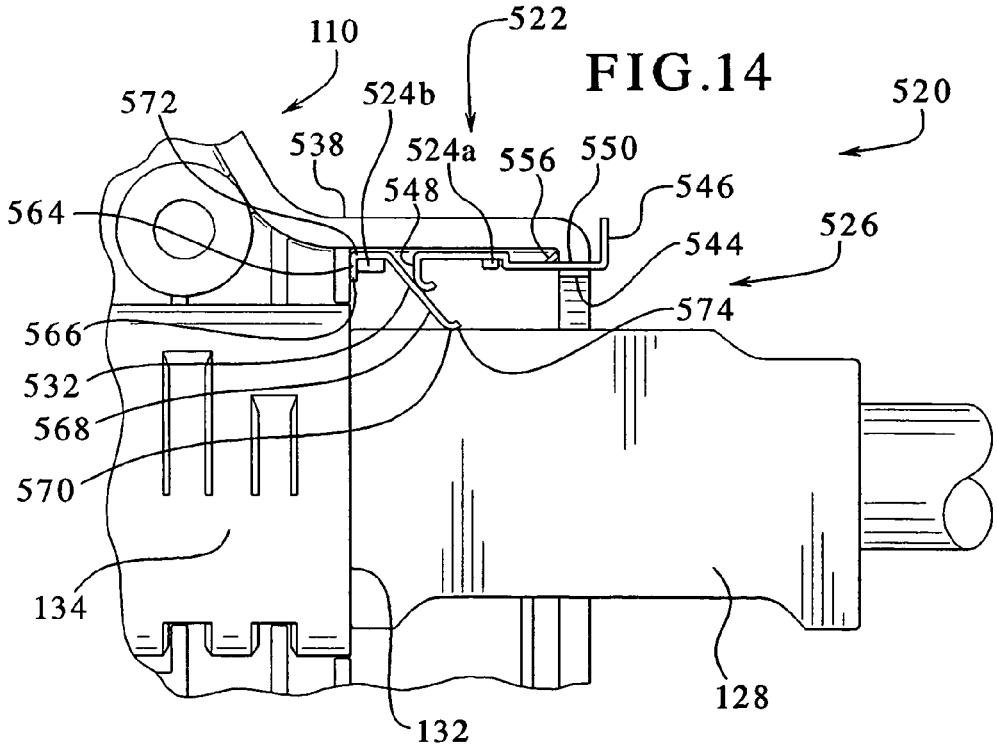
FIG. 14 is a partial cross-section view of the docking recess of the tool of FIG. 13 shown with the extension cord plug in place and the plug retaining system in an inward position.

In a preferred embodiment, the interior end 140 abuts the plug interface 132 (plug interface seen in FIGS. 13 and 14). Alternatively, the interior end 140 may extend inwardly and beyond the interface 132 (FIGS. 13 and 14) of the plug 128 to circumscribe the plug receptacle 134. With this alternative configuration, the ring 136 may have an inside diameter slightly larger than the outside diameter of the plug receptacle 134.

For attaching the ring 136 to the docking enclosure 130, at least one attachment formation 144 is disposed on the ring, such as at least one aperture, ridge and/or slit, which are configured to accept a corresponding locating structure 146, such as knobs and/or ridges, preferably located on the inner surface 138 of the docking enclosure. In a preferred embodiment, at least one aperture 148 is located on the ring, and at least one locating knob 146 is provided for insertion into the aperture. Alternatively, the attachment device 122 may include, among other things, a locating knob and a groove, or a locating knob may be disposed on the ring 136 while the aperture is located the docking enclosure 130. Further, other attachment technologies, such as adhesive or friction fit, are contemplated.

At least one slit 152 may be formed on the ring 136, preferably in the circumferential direction, and is configured for receiving at least one rib 154 which is preferably integrally formed on the inner surface 138 of the tool docking enclosure 130. When the rib 154 is engaged in the slit 152, axial movement of the attachment device 122 is prevented. Additionally, it is contemplated that the rib 154 may also be used to locate and position the plug receptacle 134 in the tool 110.

On the exterior end 142 of the ring 136, the at least one finger 126 extends generally axially and outwardly from the tool 110. In a preferred embodiment, a plurality of the fingers 126 are configured for contacting the plug 128 at a plurality of locations. Preferably, the fingers 126 extend along a side-surface 156 of the plug 128 and contact the plug proximate to a cord-extending surface 158, however, the fingers 126 are designed to not occupy space required by the user's wrist in operation of the tool 110. For this reason, it is preferable that each finger 126 generally corresponds in length to the standard plug length, and further, that each finger generally correspond in height to the standard plug height, although other dimensions are contemplated. Further, in an embodiment incorporating two fingers 126, the fingers are preferably spaced generally 180-degrees apart from each other to facilitate plug retention and to prevent biasing the plug 128 in one direction.

Adjacent to each finger 126, a flexure formation 160 is preferably configured for providing additional displacement to the finger. The flexure formation 160 is preferably a groove disposed on both sides of the finger 126, which is configured for providing each finger with additional length over which material deformation and displacement can occur. Such deformation and displacement typically occurs in a direction transverse to the longitudinal axis of the tool 110. Additional length over which deformation can occur increases the range of plug sizes that can be accommodated by the plug retaining system 120. Further, in the preferred embodiment, increased deformation can be attained without having to extend the length of each finger 126 in the outward axial direction, which can interfere with the user's hand during operation of the tool 110. Additionally, other flexure formations 160 are contemplated, such as incorporating different mechanical structure such as springs, or employing materials with a differing modulus of elasticity.

As best seen in FIG. 8, each finger 126 has a tapered portion 162, a contact surface 164 adjacent the tapered portion, and a flared portion 166 adjacent the contact portion. It should be noted that although the fingers 126 are depicted as having the same structure, it is contemplated that different finger structures may be incorporated. Further, it is contemplated that other contact portion 124, such as structure that at least partially conforms to the shape of the plug, such as a sleeve or a cradle, may be provided instead of, or in addition to, the fingers 126.

Proximate to the junction of the finger 126 with the exterior end 142, the tapered portion 162 is generally half the length of the finger, extends generally axially from the ring 136 when viewed from the side, and is preferably angled inward towards the plug 128. The flared portion 166 also extends generally axially from the ring 136 and is preferably angled outward relative to the taper of the tapered portion 162. Located generally centrally along the length of the finger 126, the contact surface 164 is defined by a rounded or arcuate bend between the tapered portion 162 and the flared portion 166. The contact surface 164 is the surface that engages the plug 128. In combination, the tapered portion 162, the contact surface 164 and the flared portion 166 are configured for allowing the contact portion to engage a multitude of different sized plugs.

In the preferred embodiment, the contact portion 124 incorporates the fingers 126, and in particular, the contact surface 164 of the fingers to apply pressure to the sides of the plug 128 to minimize side-to-side plug movement. The closer the contact surface 164 is to the cord-extending portion 158 of the plug 128, the greater the stability of the plug. Preferably integrally formed with the metal ring 136, the fingers 126 are preferably metal and overmolded with polyvinyl chloride (PVC) having a Durometer Shore A reading of 75, although other similar relatively resilient materials and constructions are contemplated. This polymeric overmold increases the friction between the finger 126 and the plug 128, which in turn, increases the amount of force required to remove the plug from the receptacle 134.

Referring now to FIG. 9, an alternate embodiment of the cord retention system 120 is generally designated 120*a*, and shared components have identical reference numbers. The main difference between the respective systems 120 and 120*a* is that the latter has three fingers 126 instead of the two disclosed in the system 120. In a three-fingered embodiment 120*a*, the fingers 126 are spaced generally 120-degrees apart and cooperatively prevent the movement of the plug 128 over a 360-degree span. The additional restraint of the three-fingered embodiment 120*a* may be incorporated in certain tools that are used in multiple planes (e.g., overhead work), such as reciprocating saws.

Figure 10:
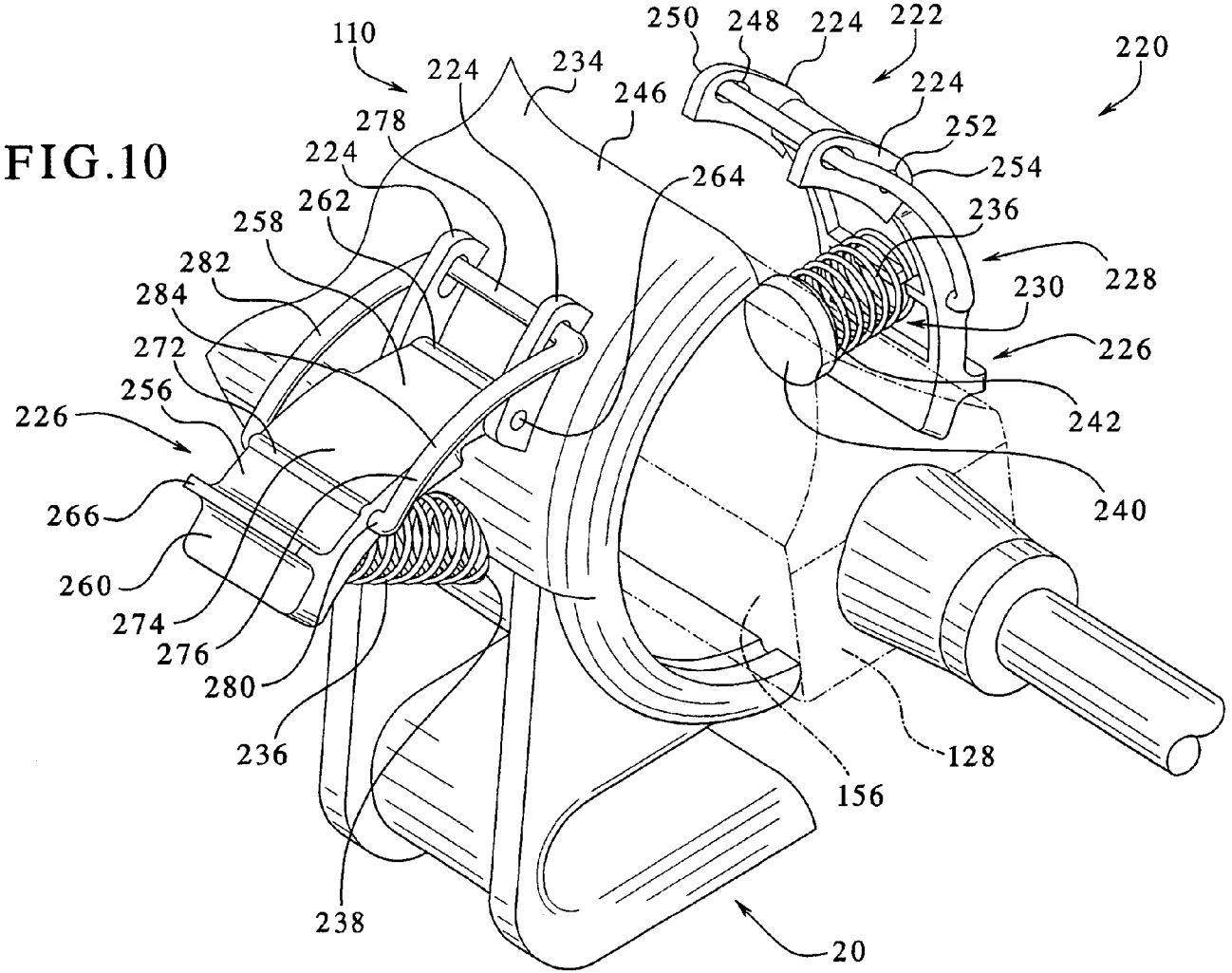
FIG. 10 is a partial cut-away perspective view of a docking recess of a tool incorporating a second embodiment of the present plug retaining system.

Referring now to FIG. 10, a plug retaining system, generally designated 220, has an attachment device 222 including at least one guide 224 and at least one latch 226, and a contact portion 228 including a clamp 230. Shared components with the plug retaining system 120 are designated with identical reference numbers. Although the preferred embodiment of the present plug retaining system 220 will be explained in detail below, it should be understood that the present plug retaining system contemplates alternative latching mechanisms in which a latch acts on a clamp to exert a radial force on the plug 128 when the latch is in an engaged position. Additionally, other ways are contemplated for selectively and releasably applying an inwardly compressing force on the plug 128, such as incorporating other mechanical structures or employing materials with spring-like properties.

In the preferred embodiment, the at least one latch 226 is associated with the outside of a docking enclosure 234. A spring 236 is attached generally centrally to the latch 226 and protrudes radially through an aperture 238 in the docking enclosure 234. Additionally, a clamp member 240 is provided at a distal end 242 of the spring 236 and is configured to engage and apply radial force on the plug 128 at a side surface 156. In the preferred embodiment, the clamp member 240 is resilient or rubber-like, but the type of material may vary to suit the application. Although two latches 226 are depicted, it should be understood that the number of latches may vary to suit the application.

Provided on an outside surface of the docking enclosure 246 and associated with each latch 226 is at least one pair of identical guides 224, disposed in spaced and parallel orientation to each other. Further, each guide 224 is preferably integrally formed with the docking enclosure 246, and is generally rectangular, having a larger hole 248 disposed on a first end 250 of the guide. The larger hole 248 is generally oval in shape, with the major axis generally parallel to the length of the guide. A smaller hole 252 is disposed on a second end 254 of the guide 224. The corresponding larger holes 248 and the smaller holes 252 on each pair of guides 224 are generally aligned in the axial direction of the docking enclosure 234.

In the preferred embodiment, the latch 226 has a buckle closure member 256 that is preferably partially cylindrical and generally conforms to the outside surface 246 of the docking enclosure 234. The buckle closure member 256 is preferably a relatively thin member, preferably with a length at least twice the width, and has a pivot end 258 and a contact end 260. However, other configurations of the closure member 256 are contemplated. At the pivot end 258, the width is dimensioned to be smaller than the distance between the guides 224 to allow the buckle closure member 256 to pivot between the guides 224. Further, a sleeve 262 is preferably integrally formed with and disposed on the pivot end 258. When an anchor bar 264 is inserted through the smaller holes 252 of the guide 224, and through the sleeve 262 on the pivot end 258, the anchor bar 264 fixes the point of pivot of the buckle closure member 256 with respect to the tool 110. It is contemplated that the various embodiments of the cord retaining systems 120, 220, etc. may be incorporated into the same types of tools, designated 110, which may be the same types as discussed above in relation to the tool 10.

The contact end 260 of the buckle closure member 256 is a free end. A grasping formation 266 is preferably disposed at the contact end 260 which is configured to help the user manipulate the buckle closure member 256 from a closed to an open position (the latter shown on the left side of FIG. 10, the former on the right side). A second sleeve or throughbore 272 is preferably integrally formed with and provided on a central portion 274 of the buckle closure member 256.

A lever 276 having a generally rectangular shape, and preferably taking the form of a bent piece of thin, spring steel rod is provided with each buckle closure member 256 and has four, preferably integral components. A first and a second cross-bar 278, 280 are disposed substantially perpendicularly between a first and a second side-bar 282, 284. The first cross-bar 278 is inserted through the larger holes 248 of each guide 224, and pivots within the fixed, oval shape. The first and second side-bars 282, 284 extend along the outside of each pair of guides 224 to the central portion 274 of the buckle closure member 256 and generally have the same contour as the member. The second cross-bar 280 is preferably formed of shortened end segments, and is inserted through each end of the second sleeve 272 on the central portion 274 of the buckle closure member 256. Together, the four components 278, 280, 282, 284 of the lever 276 transmit force from the latch 226 to the clamp 230.

When the buckle closure member 256 is in the closed position (FIG. 10, right side), the spring 236 protrudes through the aperture 238 in the docking enclosure 234 and contacts the plug 128. Both the buckle closure member 256 and the plug 128 act on the spring 236 and force the spring from a zero-force condition into compression. Depending on the size of the plug 128, the spring 236 will be compressed a greater or smaller amount. In turn, the spring 236 acts on the plug 128 and the buckle closure member 256 with equal and opposite force.

Countering the force of the spring 236 acting on the buckle closure member 256, and keeping the member in the closed position, is the tension acting along the lever components 278, 280, 282, 284 and the compression acting within the buckle closure member 256. Once the buckle closure member 256 is manually pivoted to the closed position, the particular configuration of the lever 276 and the member tends to keep the latch 226 in the closed position despite the countering force of the spring 236. When the user decides to disconnect the plug 128 from the tool 210, the clamp 230 is disengaged from the plug 128. The user applies a manual force on the contact end 260 to pivot the buckle closure member 256 away from the tool 210 to the open position (FIG. 10, left side). The force of the springs 236 are thus relaxed.

Figure 11:
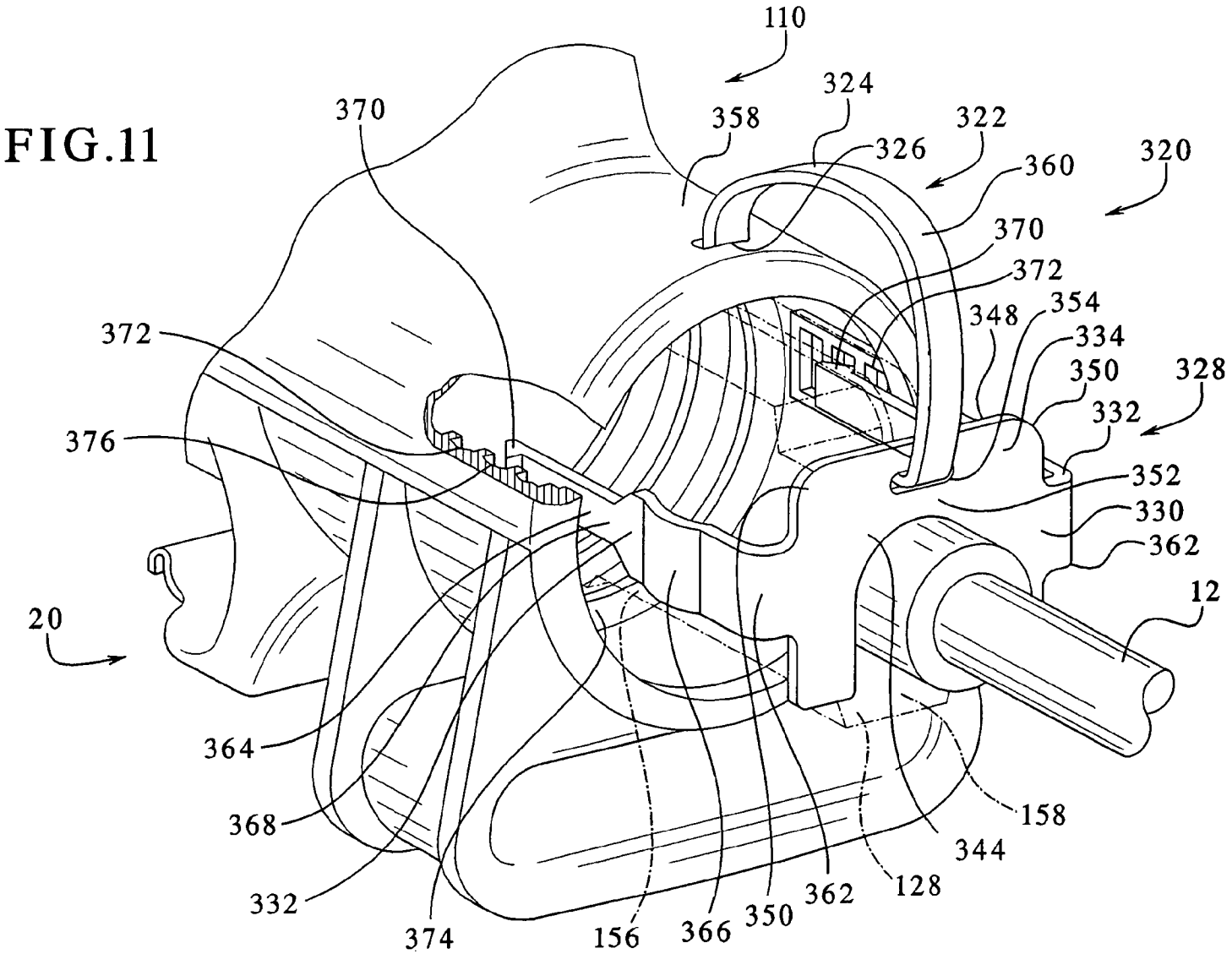
FIG. 11 is a perspective view of a docking recess of a tool incorporating a third embodiment of the present plug retaining system.

Referring now to FIG. 11, in addition to the cord retaining system 20, a plug retaining system generally designated 320, is alternatively provided for retaining the plug 128 in a docking enclosure 358. Shared components between the plug retention systems 120, 220 and 320 are designated with identical reference numbers. The plug retaining system 320 has an attachment device 322 including a tether 324 and a tool tether hole 326, and a contact portion 328 including a cradle 330. The cradle 330 includes a pair of generally parallel legs 332 separated by a crown 334 to form a general "U"-shape. For facilitating use of the plug retaining system 320, the cradle 330 is configured to closely conform to the overall shape of the plug 128. Additionally, the crown 334 is configured to be secured proximal to or flush against the cord-extending surface 158 of the plug 128.

Each leg 332 of the cradle 330 is substantially perpendicular to the crown 334, and extends along the side surface 156 of the plug 128. However, the legs 332 preferably do not exceed the axial length of the plug 128 to prevent engagement of the legs 332 with the plug interface 132 (not shown in this embodiment) on the tool 110. While a two-legged cradle 330 is depicted, it is contemplated that the present cradle is not limited to two legs 332, but may have any number of legs, or alternatively, may have any structure that partially or fully encapsulates the plug 128.

The crown 334 is generally "C"-shaped when viewed from the rear and flat, the outside dimensions of the crown substantially corresponding to the dimensions, particularly the width, of the cord-extending surface 158 of standard plugs. A cord-receiving portion 344 of the crown 334 generally corresponds to the center of the "C" shape, and is configured to receive a variety of gauges of cord 12. Preferably, the cord-receiving portion 344 receives the cord 12 at or near the junction of the cord with the plug 128 at the cord-extending surface 158. While it is contemplated that the crown 334 may have a variety of shapes and sizes, it is preferred that the crown has rounded edges to avoid piercing or damaging the plug 128 or cord 346, and it is also preferred that the cord-receiving portion 344 provide adequate clearance for ease of insertion of the cord. Additionally, a plug-facing surface 348 of the crown 334 is configured to engage the cord-extending surface 338 of the plug 128 to resist any outward movement of the plug in the axial direction, thereby preventing plug disconnect.

The present crown 334 includes a pair of shoulders 350 separated by a tether-receiving portion 352. A cradle tether hole 354 for receiving the tether 324 is generally centrally disposed on the tether-receiving portion 352, and preferably has rounded edges to prevent damage to the tether. A tool tether hole 326 is provided on the docking enclosure 358 on the tool 110 and is generally aligned with the cradle tether hole 354 in the axial direction of the plug 128 to form a complete loop 360 through the cradle tether hole 354 and the tool tether hole 326. Further, the cradle 330 can easily be stored with the tool 110 since the tether 324 prevents separation of the plug retaining system 320 from the tool 310.

On the opposite end of each shoulder 350, a proximal end 362 of each leg intersects the crown 334 at a substantially right angle. The shoulders 350 may be configured to extend slightly beyond the dimensions of a standard plug, or in the alternative, the proximal end 362 of each leg 332 may be bowed out a slight distance in order to accommodate a range of plug shapes and sizes. Located between the proximal end 362 and a distal end 364 of each leg 332, a flexure portion 366 is configured to enable a remaining portion 368 of the leg 332 to engage or clamp the side surfaces 340 of a variety of plug shapes and sizes.

At the distal end 364 of each leg 332, an outwardly extending foot 370 is provided for engaging one of a plurality of side snaps 372 disposed on an inside surface 374 of the docking enclosure 358. The docking enclosure 358 is preferably generally cylindrical and extends substantially the length of the plug 128 when the plug is engaged with the tool 110, but other shapes and sizes are contemplated. Inside the docking enclosure 358, each side snap 372 is preferably a groove 376 dimensioned to be bigger than the foot 370, and preferably having a depth deeper than the length of the foot. The locations of the side snaps 372 correspond to the positioning of the legs 332 on the cradle 330, and are configured to retain the foot 370, or any structure on the leg configured to prevent axial movement of the cradle.

The feet 370 may be released from the side snaps 372 or readjusted into new side snaps by exerting pressure on the flexure portion 366 of each leg 332 and moving the cradle 330 in the axial direction. The plurality of side snaps 372 are provided to accommodate plugs having a variety of different axial lengths and to allow the crown 334 to maintain a generally flush relationship with the cord-extending surface 340 of the plug 336.

Preferably, the cradle 330 is integrally formed of steel and then vinyl coated, but other materials are envisioned. In particular, suitable materials of construction are preferably non-electrically conductive and will not have sharp edges to potentially harm the plug 128 or the cord 12, or that could expose live wire. Further, durable materials are preferred to minimize the effects of wear and abrasion that can occur between the plug 128 and cord 346.

Figure 12:
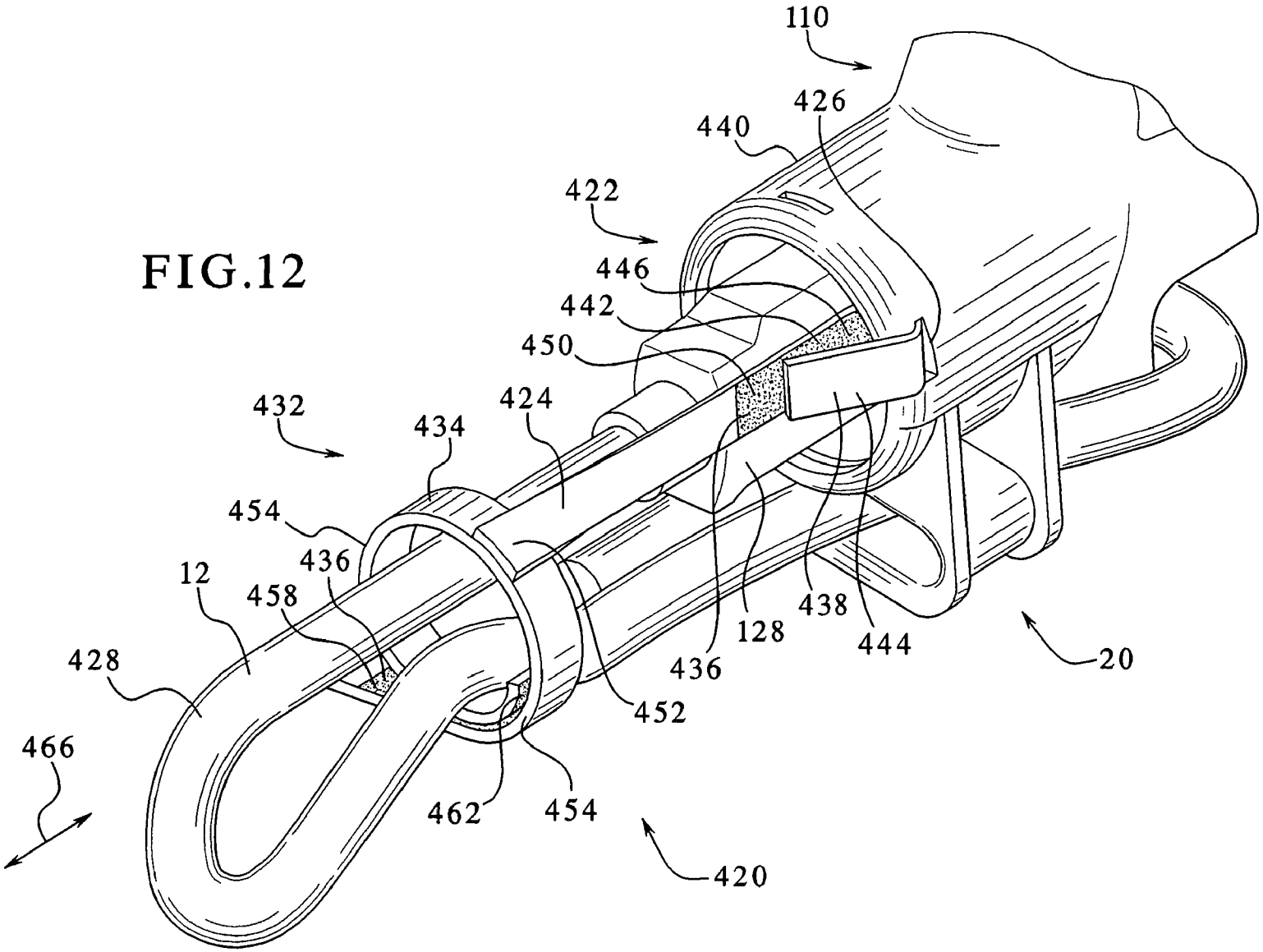
FIG. 12 is a perspective view of a docking recess of a tool incorporating a fourth embodiment of the present plug retaining system.

Referring now to FIG. 12, a cord retaining system 20 and a plug retaining system, generally designated 420, has an attachment device 422 including a tether 424 and a tool tether hole 426 (similar to the tether hole 326) which adjustably secures a cord loop 428 a distance from the tool 110 and a contact portion 432 including a wrap 434 which adjustably encircles the cord loop. Shared components among the systems 120, 220, 320 and 420 are designated with identical reference numbers.

The tether 424 is preferably an elongate piece of textile, preferably a high density knit fabric or any other flexible material. Further, at least a portion of the tether 424 exhibits fastening qualities, or has fastening structure 436, to attach itself to the tool 110. In the preferred embodiment, a looped portion 438 of the tether 424 is received in the tool tether hole 426 disposed on a docking enclosure 440 in a general hook and loop fashion. Alternatively, a plurality of tool tether holes 426 may be provided, and further, the tool tether hole may be provided anywhere on the tool 110. The tool tether holes 426 are preferably dimensioned to be slightly larger than the width and depth dimensions of the tether 424, and preferably have rounded edges to prevent excessive friction with or damage to the tether.

When the tether 424 is looped through the tool tether hole 426, an inside surface 442 of the tether has fastening structure 436 disposed on both a leading portion 444 and a trailing portion 446 of the tether. The leading portion 444 is the portion which is looped through the tool tether hole 426, and the trailing portion 446 is the portion which is not looped through the tool tether hole 426 and which remains substantially axially aligned with the length of the plug 128. The tether 424 is removably connected to itself by fastening the leading portion 444 and the trailing portion 446 to each other.

In the preferred embodiment, mating portions 450 of Velcro®, or other hook and loop fastener material, are disposed along both the leading and trailing portions 444, 446, but it is also contemplated that the entire tether 424 is a Velcro® strip. Further, other fastening structures 436 are contemplated, such as snaps, buttons, clasps and hooks provided along the length of the tether 424 to allow the trailing portion 446 to be shortened or elongated. Alternatively, a fastener not providing adjustability along the axial length of the plug, such as the leading and trailing portions 444, 446 being sewn together, or a tether 424 of fixed length is also envisioned.

At a distal end 452, the tether 424 is attached, preferably sewn, at a substantially right angle with the elongate wrap 434 made of the same material. Alternatively, the tether 424 and the wrap 434 may be attached by other fastening technologies. Further, the tether 424 and the wrap 434 may be a unitary piece, or the tether and the wrap may be made of different materials. Further still, the tether 424 and the wrap 434 may have different dimensions. Since the tether 424 and the wrap 434 are attached to each other, accidental separation of parts is prevented when the tool 410 is in storage. In the preferred embodiment, the tether 424 is sewn to the wrap 434 substantially centrally to form a "T" shape including two legs 454, each leg of the wrap having substantially the same length, although differing lengths are contemplated. The legs 454 of the "T" shape are configured to attach to each other and to encircle the cord loop 428.

The wrap 434 is also provided with fastening means 436, preferably Velcro® material, and is configured to be removably connected to itself. In the preferred embodiment, a first Velcro® material strip 456 is disposed on an inside surface 458 of the wrap 434, and a mating Velcro® material strip 460 is disposed on an outside surface 462 of the wrap. When the wrap 434 is in use, the cord 346 exits the plug 128 and extends generally axially away from the tool 410, and is looped back toward the tool by the user to form the cord loop 428.

Optionally before or after securing the tether 424 to the tool 410, the two legs 454 of the wrap 434 are placed around each side of the cord loop 428. The legs are then pulled tight to cinch the cord loop 428 to a desired amount. One of the legs 454 is placed proximal to the cord 346 and tucked under the other leg, while the other leg is placed over the first leg. The outside surface 462 of one leg 454 and the inside surface 458 of the other leg matingly engage to encircle the cord loop 428 and to maintain the cord 464 in substantial axial alignment with the length of the plug 448.

When the cord loop 428 is encircled, the wrap 434 and the tether 424 are disposed in operational relationship to each other to restrain the cord loop along a cord axis 466. The cord axis 466 is generally parallel to the major axis of the tool. Such a configuration lessens the likelihood of cord pullout.

Referring now to FIGS. 13 and 14, a plug retaining system, generally designated 520, has an attachment device 522 including support ribs 524*a*, 524*b* and a contact portion 526 including a clamp 528. Shared components are designated with identical reference numbers. In the present embodiment, the clamp 528 has a push-button member 530 and a corresponding clamp member 532 for contacting the plug 128.

The push-button member 530 is preferably relatively thin, formed from sheet metal, or equivalent metal, plastic, or similar material, and has a generally elongated and angular "S" shape when viewed from the side. An exposed portion 536 of the push-button member 530 corresponds to the top of the "S" shape and is located outside of a docking enclosure 538 of the tool 110, while a hidden portion 540 of the push-button member 530 corresponds to the bottom of the "S" shape and is located proximate to both an inside surface 542 and a lip 544 of the docking enclosure 538. Further, a contact portion 546 of the push-button member 530 is disposed at the end of the exposed portion 536, and an engaging portion 548 is disposed at the end of the hidden portion 540. Thus, the contact portion 546 and the engaging portion 548 are located at opposite ends of the member 530.

The push-button member 530 is disposed in a groove 550 located on the lip 544 of the docking enclosure 538, and is configured to slide axially toward and away from the plug interface 132. Supporting the push-button member 530 proximate to the inside surface 542 of the docking enclosure 538 and aligning the push-button member with the clamp member 532, a first support rib 524*a* is preferably integrally molded with the docking enclosure 528. When the push-button member 530 is in an outward position, as shown in FIG. 13, the first support rib 524*a* supports the push-button member 530 generally at the lower end of the "S." The first support rib 524*a* may abut the substantially right-angled engaging portion 548 to prevent further outward movement of the push-button member 530. When the push-button 530 is in an inward position, as shown in FIG. 14, the first rib 524*a* supports the push-button member 530 generally centrally and abuts the center of the "S" shape to prevent further inward movement.

A catch 556 is preferably disposed generally centrally on the exposed portion 536 of the push-button member 530 when the member is in the outward position. Preferably, the catch 556 is disposed on a surface 558 of the push-button member 530 facing away from the plug 128 and is angled toward the contact portion 546. The catch 556 is preferably integrally formed with the push-button member 530, and further, is preferably made from a material with high resiliency properties. The catch 556 maintains the push-button member 530 in an inward and an outward position. To this end, when the push-button member 530 is moved inward, large amounts of stress are localized on the catch 556, and the catch displaces the member by ramping the member away from the lip 544, and slight deformation of the catch may occur. When the push-button member 530 is displaced and the catch 556 emerges on the other side of the lip 544, the catch locks the push-button member in the inward position. Release of the push-button member 530 occurs when the user applies a downward force on the member, displacing the contact portion 546 downward, in turn moving the catch 556 out from behind the lip 544, and pulling the member outward.

The push-button member 530 works in conjunction with the clamp member 532 to secure the plug 128 onto the receptacle 134. Preferably, the clamp member 535 is also a thin member of sheet metal, or any other material exhibiting high resiliency properties, and is supported by a second support rib 524*b*. Similar to the first support rib 524*a* used for the push-button member 530, the second support rib 524*b* is preferably integrally molded with the docking enclosure 538.

The clamp member 532 has an anchor 564 on a first end 566 and an elongate leg 568 on a second end 570. Between the first and second ends 566, 570 of the clamp member 532 is a flat portion 572 which rests on the second support rib 562 such that the anchor 564 is fixedly disposed between the rib and the docking enclosure 538.

The elongate leg 568 of the clamp member 532 has a generally concave shape, with the concavity generally outwardly focused towards the docking enclosure 538. A foot 574 is disposed substantially at a right-angle at the second end 570 of the elongate leg 568. When the push-button member 530 is in the outward position, the engaging portion 548 of the member contacts the elongate leg 568 near the foot 574. The elongate leg 568 remains concave until the push-button member 530 is pushed inward. When this occurs, the engaging portion 548 deforms and displaces the elongate leg 568 into a generally linear shape as the engaging portion slides up the leg. The engaging portion 548 displaces the elongate leg 568 to clamp down on the surface of the plug 128 with the foot 574. The foot 574 applies radial force on the plug 128 which helps retain the plug in the receptacle 560.

Figure 15:
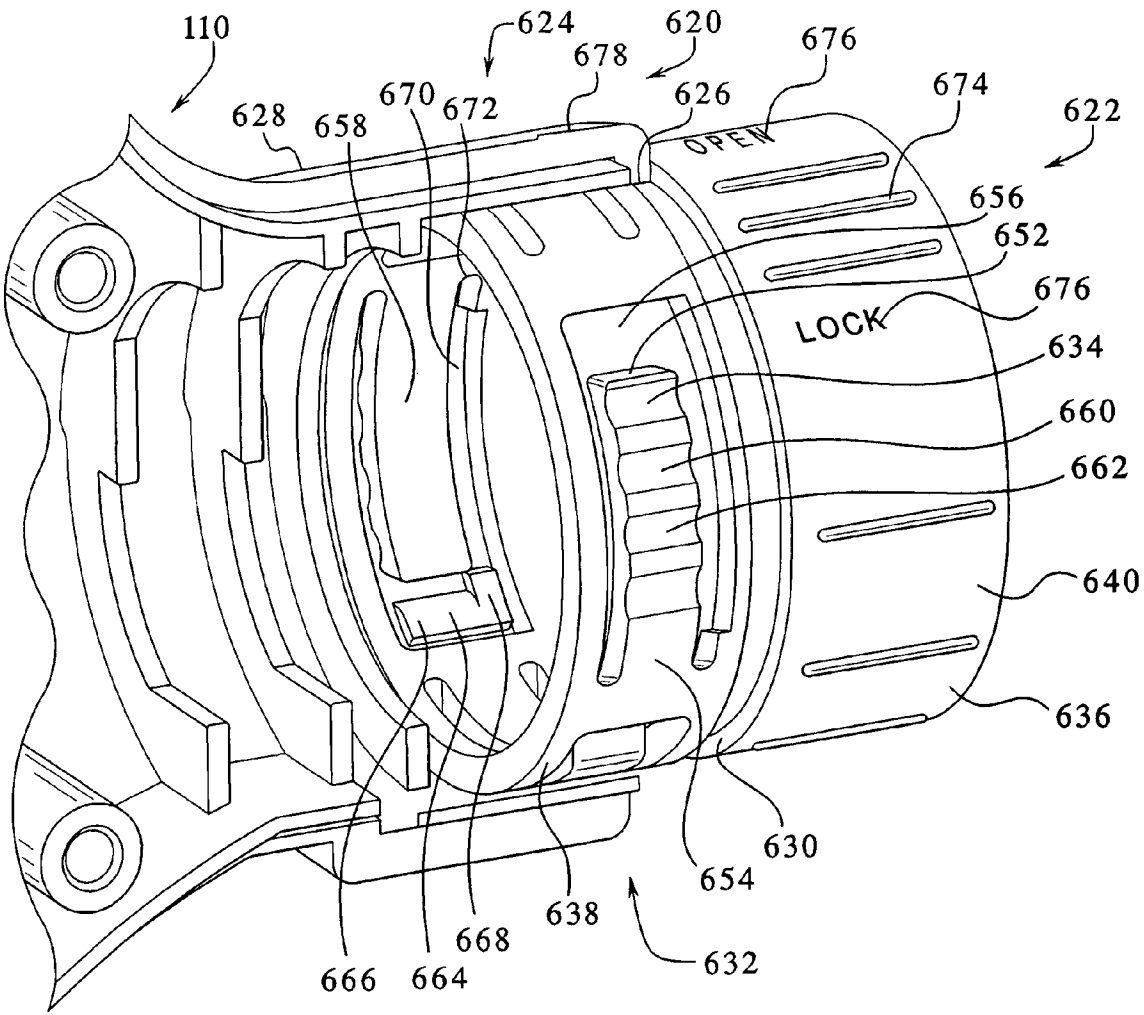
FIG. 15 is a partial cut-away perspective view of a docking recess of a tool incorporating a sixth embodiment of the plug retaining system.
Figure 16:
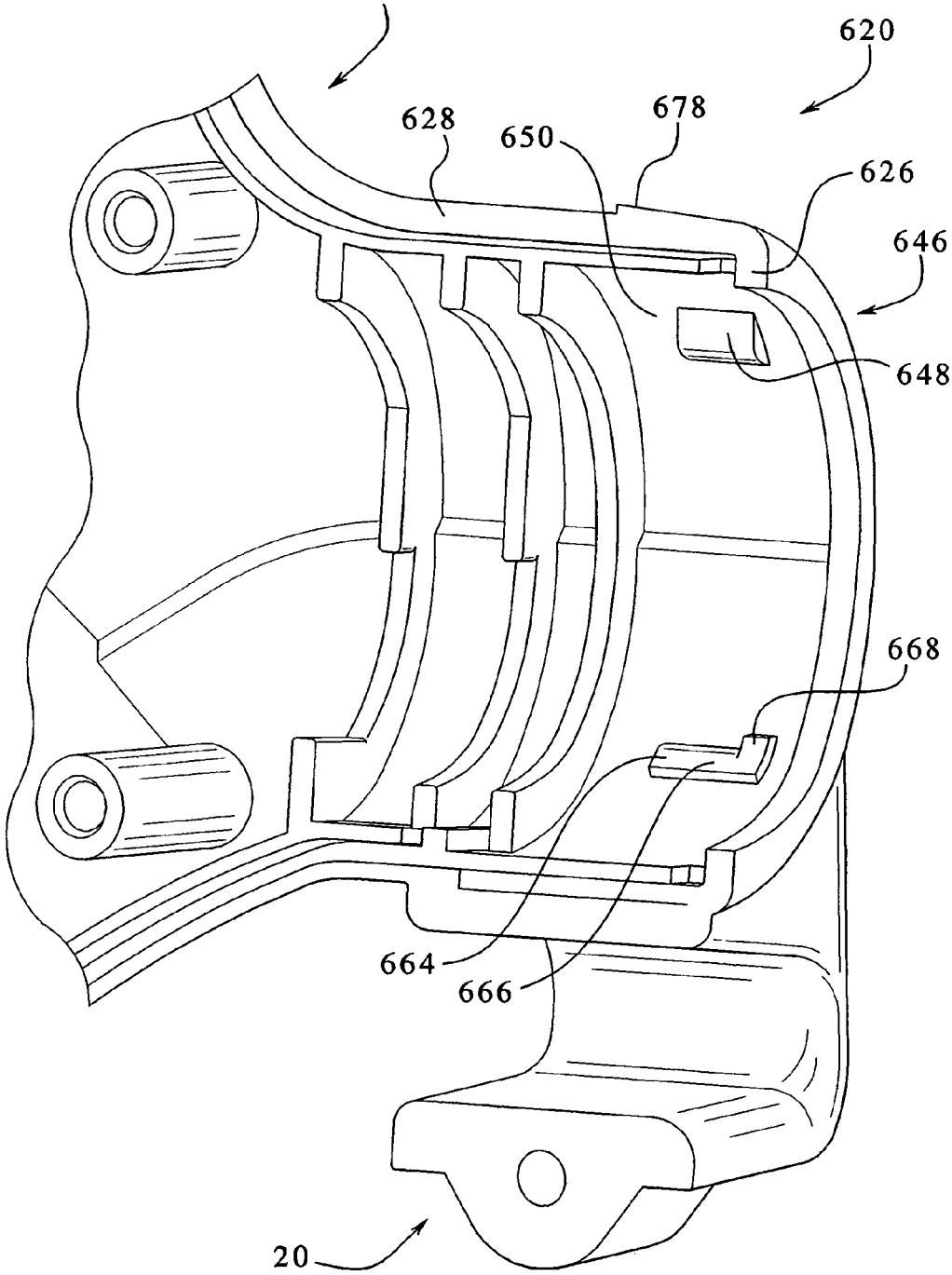
FIG. 16 is a partial cut-away perspective view of the docking recess of the tool of FIG. 15.

Referring now to FIGS. 15 and 16, a plug retaining system, generally designated 620, includes a scroll collar 622. Shared components are designated with identical reference numbers. The plug retaining system 620 has an attachment device 624 including a lip 626 disposed on a docking enclosure 628 and a mating groove formation 630 disposed on the collar 622 and contact portion 632 including a plurality of splines 634. The scroll collar 622 is a generally cylindrical sleeve 636 that is mounted within and preferably protrudes beyond the docking enclosure 628. In the preferred embodiment, the scroll collar 622 has an internal portion 638 and an external portion 640, the internal portion is disposed inside the docking enclosure 628 while the external portion extends outside of the docking enclosure. In order for the plug 128 to interface with the receptacle 134 (not shown in this embodiment), the plug must be received within the collar 622.

Located on the internal portion 638 of the collar 622, the groove formation 630 matingly engages the lip 626, preferably located on the end of the docking enclosure 628. This configuration permits the collar 622 to be disposed on the tool 110 as well as to be rotatable with respect to the tool. Additionally, other configurations, such as rollers on a track, which would permit the collar to be secured to the tool and to be rotatable with respect to the tool, are contemplated.

Disposed adjacent to or abutting the receptacle 134 (not shown), the internal portion 638 of the collar 622 includes the contact portion 632, such as the plurality of splines 634, configured to accept corresponding locating structure 646, such as pawls 648, on an inner surface 650 of the docking enclosure 628. Upon accepting the locating structure 646, the plurality of splines 634 are displaced inward towards the plug 128. The combination of the contact portion 632 and the locating structure 646, where the locating structure nests with the splines 634, is configured to permit limited rotation of the collar 622 about the axis that is shared with the docking enclosure 628.

In the preferred embodiment, the contact portion 632 includes a plurality of splines 634 that are circumferentially disposed on the internal portion 638 of the collar 622. Further, the plurality of splines 634 are integrally formed, tonguelike projections that have one free end 652 and one fixed end 654, and further, have a clearance 656 from the remainder of the collar on three sides. It is preferred that an inside surface 658 of each spline is generally smooth, and that an outside surface 660 of each spline 634 is provided with at least one notch 662. The notches 662 receive the locating structure 646 to permit limited, ratchet-like rotation of the collar 622. It should be understood that other contact portions which are associated with the docking enclosure and are configured to contact the plug are also contemplated.

As the collar 622 is rotated, the pawls 648 located on the docking enclosure 628 engage the first notch on the outside surfaces 660 of the splines 634 adjacent the free end 652, and force the splines to be displaced inward. The maximum inward displacement of the splines 634 is at the free end 652 while the displacement at the fixed end 654 is zero. As the collar 622 is further rotated, the pawls 648 engage the subsequent notches 662 located towards the fixed end 654 which results in increased displacement of the free end 652, which in turn, results in increased radial force on the plug 128. In this configuration, the pawls 648 impart forward motion and prevent backward motion, and allow the splines 634 to accommodate different sizes of plugs.

To prevent stressing the splines 634 to the brink of material failure and to preserve the elastic properties of the material, at least one stop 664 is disposed on the inner surface 650 of the docking enclosure 628. The stop 664 is preferably "L"-shaped and includes a long leg 666 that is transverse to the direction of motion of the collar 622, and a short leg 668 that is parallel to the direction of motion of the collar. Other shapes are contemplated provided they halt relative rotation of the collar 622. When the collar 622 is rotated a maximum amount corresponding to the location of the stop 664, the spline 634 is ramped over the long leg 666 and the long leg engages the notches 662 to displace the spline inward. At the same time, the short leg 668 slides along a channel 670 of the clearance 656 until it engages a stop wall 672. When the stop 664 engages the stop wall 672, the splines 634 are at a maximum displacement and the stop prevents further rotation of the collar 622. To retract the splines 634 and to remove the plug 642 from the receptacle 644, the collar 622 must be manually rotated in the opposite direction to retract the splines.

For ease of rotation of the collar 622, gripping formations 674 are disposed on the external portion 640 to create increased friction with the user's hand. In the preferred embodiment, the gripping formations 674 are outwardly disposed ridges of overmolded rubber. The external portion 640 of the collar 622 also has at least one, and preferably multiple indicators 676, such as the words "LOCK" and "OPEN" which are each associated with and in radial alignment with a marker 678 on the docking enclosure 628. That is, each indicator 676, when aligned with the marker 678, indicates whether the splines 634 are locked at a point of maximum rotation, or whether the splines are fully retracted in an open position. Alternatively, symbols or other formations may be used as indicators and markers to show whether the plug is retained.

While particular embodiments of the present extension cord retention system and plug retention system for a power tool have have been described herein, it will be appreciated by those skilled in the art that changes and modifications may be made thereto without departing from the invention in its broader aspects and as set forth in the following claims.

What is claimed is:

1. A plug retaining system for use with a power tool configured for maintaining electrical continuity between the plug and the tool, said system comprising:

contact means configured for engaging the plug disposed on the tool; and attachment means configured for attaching said contact means to the tool;

wherein said attachment means includes a ring disposed on the tool configured for attaching said contact means to the tool and said contact means includes at least one finger extending from said ring configured for engaging the plug; and wherein said at least one finger includes a tapered portion extending generally axially from said ring;

a flared portion extending generally axially from said ring; and a contact surface configured for engaging the plug, wherein said contact surface is formed between said tapered portion and said flared portion.

2. The plug retaining system of claim 1 wherein said ring further comprises at least one attachment formation, wherein one of said at least one attachment formation is an aperture, a ridge, a slit and a smooth surface configured for engaging corresponding structure on the tool.

3. A plug retaining system for use with a power tool configured for maintaining electrical continuity between the plug and the tool, said system comprising:

contact means configured for engaging the plug disposed on the tool; and attachment means configured for attaching said contact means to the tool;

wherein said attachment means includes at least one latch disposed on the tool and configured for attaching said contact means to the tool; and said contact means includes at least one clamp extending radially from said at least one latch and configured for engaging the plug.

4. The plug retaining system of claim 3 wherein said at least one clamp further comprises a spring attached to said at least one latch and a clamp member disposed at a distal end of said spring, wherein said at least one latch is configured for transmitting force to said at least one clamp to engage the plug.

5. The plug retaining system of claim 3 further comprising a docking enclosure provided on the tool, wherein said clamp protrudes through an aperture in said docking enclosure.

6. A plug retaining system for use with a power tool configured for maintaining electrical continuity between the plug and the tool, said system comprising:

contact means configured for engaging the plug disposed on the tool; and attachment means configured for attaching said contact means to the tool;

wherein said contact means includes a cradle partially conforming to the shape of the plug configured for engaging the plug; and said attachment means includes a tether attached to said cradle and to the tool configured for attaching said cradle to the tool.

7. The plug retaining system of claim 6 wherein said cradle includes:

a crown on said cradle configured to be proximately located to a cord-extending surface of the plug, wherein said crown includes a cord-receiving portion configured for receiving a cord from said cord-extending surface of the plug; and at least one leg extending from said crown and configured for attaching said cradle to the tool.

8. The plug retaining system of claim 7 wherein said cradle includes:

a foot disposed at a distal end of said at least one leg configured for engaging the tool; and a flexure portion located on said at least one leg configured for releasing said foot from the tool.

9. A plug retaining system for use with a power tool configured for maintaining electrical continuity between the plug and the tool, said system comprising:

contact means configured for engaging the plug disposed on the tool; and attachment means configured for attaching said contact means to the tool;

wherein said attachment means includes:

a tether configured for attachment to the tool; and said contact means includes a wrap disposed at a distal end of said tether and configured for engaging a loop of the cord.

10. The plug retaining system of claim 9 further comprising: fastening means disposed at at least one location on said wrap, wherein said wrap is configured to be removably connected to itself.

11. The plug retaining system of claim 10 wherein said wrap and said tether are disposed in operational relationship to each other when the loop of the extension cord is encircled to restrain the loop along a cord axis, said cord axis being generally parallel to a major axis of the tool.

12. A plug retaining system for use with a power tool configured for maintaining electrical continuity between the plug and the tool, said system comprising:

contact means configured for engaging the plug disposed on the tool; and attachment means configured for attaching said contact means to the tool;

wherein said contact means includes a clamp configured for engaging the plug; and said attachment means includes at least one support rib disposed on the tool and configured for attaching said clamp to the tool.

13. The plug retaining system of claim 12 wherein said clamp further comprises:

a push-button member slidingly disposed on the tool; and a clamp member disposed on the tool adjacent said push-button member;

wherein said push-button member is configured for positioning said clamp member into engagement with the plug.

14. The plug retaining system of claim 13 wherein said push-button member further comprises:

a contact portion disposed on said push-button member configured for contact with the user;

an engaging portion disposed on said push-button member configured for deforming and displacing said clamp member into engagement with the plug; and a catch disposed generally centrally on said push-button member configured for retaining said push-button member in an inward and an outward position.

15. A plug retaining system for use with a power tool configured for maintaining electrical continuity between the plug and the tool, said system comprising:

contact means configured for engaging the plug disposed on the tool; and attachment means configured for attaching said contact means to the tool;

wherein said attachment means includes a collar rotatably disposed on the tool configured for attaching said contact means to the tool;

wherein said contact means includes at least one spline associated with said collar and configured for engaging the plug; and wherein said at least one spline has a free end and a fixed end, said free end configured for deforming and displacing upon engagement with a locating structure disposed on the tool.

16. The plug retaining system of claim 15 wherein said locating structure comprises at least one pawl and at least one stop, and wherein said at least one spline comprises at least one notch, said at least one pawl and said at least one notch are configured for permitting limited rotation of said collar, and said at least one stop is configured for preventing rotation of said collar.

17. A plug retaining system for use with a power tool configured for maintaining electrical continuity between the plug and the tool, said system comprising:

a ring disposed on the tool configured for attaching a contact means to the tool, said ring disposed on the tool immediately proximate a receptacle of the tool configured to receive the plug; and at least one finger extending from said ring configured for engaging the plug;

wherein said at least one finger further comprises:

a tapered portion extending generally axially from said ring;

a flared portion located at a distal end of said at least one finger; and a contact surface configured for engaging the plug, wherein said contact surface is formed between said tapered portion and said flared portion.

18. The plug retaining system of claim 17 wherein said ring further comprises at least one attachment formation, wherein one of said at least one attachment formation is an aperture, a ridge, a slit and a smooth surface configured for engaging corresponding structure on the tool.

19. The plug retaining system of claim 18 wherein said ring is friction fit into said at least one locating structure.

* * * * *